US006346918B1

(12) United States Patent
Munk

(10) Patent No.: US 6,346,918 B1
(45) Date of Patent: Feb. 12, 2002

(54) SCAN INDEPENDENT ARRAY FOR CIRCULAR POLARIZATION RECEPTION AND TRANSMISSION

(75) Inventor: Peter Munk, Dayton, OH (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 09/516,413

(22) Filed: Mar. 1, 2000

(51) Int. Cl.[7] ..... H01Q 19/00

(52) U.S. Cl. ..... 343/756; 343/700 MS; 343/754; 343/793; 343/853

(58) Field of Search ..... 343/700 MS, 754, 343/756, 757, 770, 793, 795, 829, 846, 850, 853, 873; H01Q 19/00

(56) References Cited

U.S. PATENT DOCUMENTS

| | | | | |
|---|---|---|---|---|
| 3,854,140 A | * | 12/1974 | Ranghelli et al. | 343/756 |
| 4,125,841 A | | 11/1978 | Munk | 343/909 |
| 4,131,896 A | * | 12/1978 | Miller | 343/815 |
| RE29,911 E | * | 2/1979 | Munson | 343/700 MS |
| 4,434,425 A | * | 2/1984 | Barbano | 343/797 |
| 5,255,004 A | * | 10/1993 | Berkowitz et al. | 343/853 |
| 5,661,494 A | * | 8/1997 | Bondyopadhyay | 343/700 MS |

OTHER PUBLICATIONS

E. G. Magill et al., "Wide–Angle Impedance Matching of a Planar Array Antenna by a Dielectric Sheet", IEEE Transactions on Antennas and Propagation, vol. AP–14, No. 1, Jan. 1966, pp. 49–53.

James J. Campbell, et al., "A Broad–Band Wide–Angle Scan Matching Technique for Large Environmentally Restricted Phased Arrays", IEEE Transactions on Antennas and Propagation, vol. AP–20, No. 4, Jul. 1972, pp. 421–427.

Chao–Chun Chen, "Broad–Band Impedance Matching of Rectangular Waveguide Phased Arrays", IEEE Transactions on Antennas and Propagation, vol. AP–21, No. 3, May 1973, pp. 298–302.

(List continued on next page.)

*Primary Examiner*—T. Phan
(74) *Attorney, Agent, or Firm*—Daly, Crowley & Mofford, LLP

(57) ABSTRACT

An antenna includes first and second arrays spaced apart by a dielectric slab having a predetermined thickness, each of the first and second arrays provided from antenna elements having a linear polarization with the antenna elements in said first array disposed orthogonally to the antenna elements in said second array. The antenna further includes a feed circuit coupled to said first and second antenna arrays to provide said first and second antenna arrays having a phase relationship such that the antenna receives and transmits signals having circular polarization and dielectric material having differing characteristics for providing an impedance transformation that varies with scan angle in accordance with the a scan impedance of said antenna thereby providing the antenna having a scan impedance which is substantially the same over a scan sector while at the same time preserving the response characteristic of the antenna to signals having circular polarization.

20 Claims, 16 Drawing Sheets

OTHER PUBLICATIONS

B. A. Munk et al., "Scan Independent Phased Arrays", Radio Science, vol. 14, No., 6, Nov.–Dec. 1979, pp. 979–990.

James E. Dudgeon, "Phased Array Antenna Matching: Simulation and Optimization of a Planar Phased Array of Circular Waveguide Elements", Final Report Contract NAS38–23894 CR–123820, Feb. 1972, pp. 1–74.

V.S. Filippov, et al., Wide–Band Circular–and Linear–Polarization Printed Radiators of PAA, Telecommunications and Radio Engineering, 49(8), 1995, pp. 79–83.

R. B. Waterhouse, "Scan Comparison of Several Techniques for Generating Circular Polarization in Probe–FED Microstrip Patch Arrays", 1995 IEEE, pp. 602–604.

Nirod K. Das, et al., "An Infinite Array Model for Printed Phased Array Antennas with Arbitrary Multilayer Geometries", 1990 IEEE, pp. 1433–1436.

Radha Telikepali et al., "Wide Band Microstrip Phased Array for Mobile Satellite Communications", IEEE Transactions on Microwave Theory and Techniques, vol. 43, No. 7, Jul. 1995, pp. 1758–1763.

Kuan Min Lee, et al., "Dual–Band, Dual–Polarization, Interleaved Cross–Dipole and Cavity–Backed Disk Elements Phased Array Antenna", 1997 IEEE, pp. 694–697.

* cited by examiner

SCAN INDEPENDENT ARRAY FOR CIRCULAR POLARIZATION RECEPTION AND TRANSMISSION

STATEMENTS REGARDING FEDERALLY SPONSORED RESEARCH

This invention was made with Government support under Contract No. F19628-95-C-0002 awarded by the Department of the Air Force. The Government has certain rights in this invention.

CROSS-REFERENCE TO RELATED APPLICATIONS

Not applicable.

FIELD OF THE INVENTION

This invention relates generally to antennas and more particularly to an improved circular polarized antenna with large scan angles.

BACKGROUND OF THE INVENTION

In antenna applications, it is often desirable to transmit and receive signals using circular polarization. One common technique to transmit and receive circular polarization is to use a pair of cross dipoles and by feeding a signal in phase quadrature i.e., a 90 degrees phase difference introduced between each element and its orthogonal counterpart a circular polarized signal is produced. Although a true circular polarized signal is approximated on boresight of the antenna, as signals are transmitted and received off boresight, the signal less approximates a circular polarized signal resulting in a larger VSWR.

In array antennas, the need for scan independent arrays has been recognized. It is desirable to maintain circular polarization over a large scan volume as well as constant scan impedance. In order to receive maximum power, the antenna load must be conjugate matched to the antenna scan impedance. Any variation in the scan impedance results in a mismatch between it and the load, whereby a portion of the received energy is reradiated instead of being absorbed by the load. The greater the mismatch, the larger this portion becomes. The need for this additional constraint arises when considering an array for satellite communication purposes. Antennas mounted on satellites typically transmit and receive circular polarization since their location relative to the ground-based antenna is constantly changing. Furthermore, problems resulting from Faraday rotation can also be avoided by using circular polarization.

It would, therefore, be desirable to provide an array antenna with improved scan impedance and radiation field properties when transmitting and receiving circular polarization.

SUMMARY OF THE INVENTION

In accordance with the present invention, an antenna includes a first dielectric slab having a first surface and a second opposing surface; a ground plane disposed over the second opposing surface of the first dielectric slab; a first array of antenna elements having a first polarization characteristic, said first array disposed in said dielectric slab and spaced from said ground plane by a first distance; a second array of antenna elements having a second polarization characteristic, said second array disposed in said dielectric slab and spaced from said ground plane by a second distance, wherein said second array is disposed such that the polarization characteristic of said second array is orthogonal to the polarization characteristic of said first antenna; and at least one additional dielectric slab disposed over the first surface of the first dielectric slab to compensate for variation of antenna impedance with differing scan angle. With such an arrangement, a circular polarized antenna array is provided with a scan impedance that has a minimum variation over a large scan sector.

In accordance with a further aspect of the present invention, an antenna includes first and second arrays spaced apart by a first dielectric slab having a predetermined thickness, each of said first and second arrays provided from antenna elements having a linear polarization with the antenna elements in said first array disposed orthogonally to the antenna elements in said second array. The antenna further includes a feed circuit coupled to said first and second antenna arrays to provide said first and second antenna arrays having a phase relationship such that the antenna receives and transmits signals having circular polarization and dielectric material having differing characteristics for providing an impedance transformation that varies with scan angle in accordance with the a scan impedance of said antenna thereby providing the antenna having a scan impedance which is substantially the same over a scan sector while at the same time preserving the response characteristic of the antenna to signals having circular polarization. With such an arrangement the impedance of the transmitter/receiver can be essentially conjugate matched to the array scan impedance across a large scan volume, resulting in maximum transmitted/received power. In addition, such an arrangement also maintains near perfect circular polarization over this same scan sector, any deviation from which would produce additional power loss in a transmit/receive signal.

BRIEF DESCRIPTION OF THE DRAWINGS

The foregoing features of this invention, as well as the invention itself, may be more fully understood from the following description of the drawings in which.

DETAILED DESCRIPTION OF THE INVENTION

Figure 1:
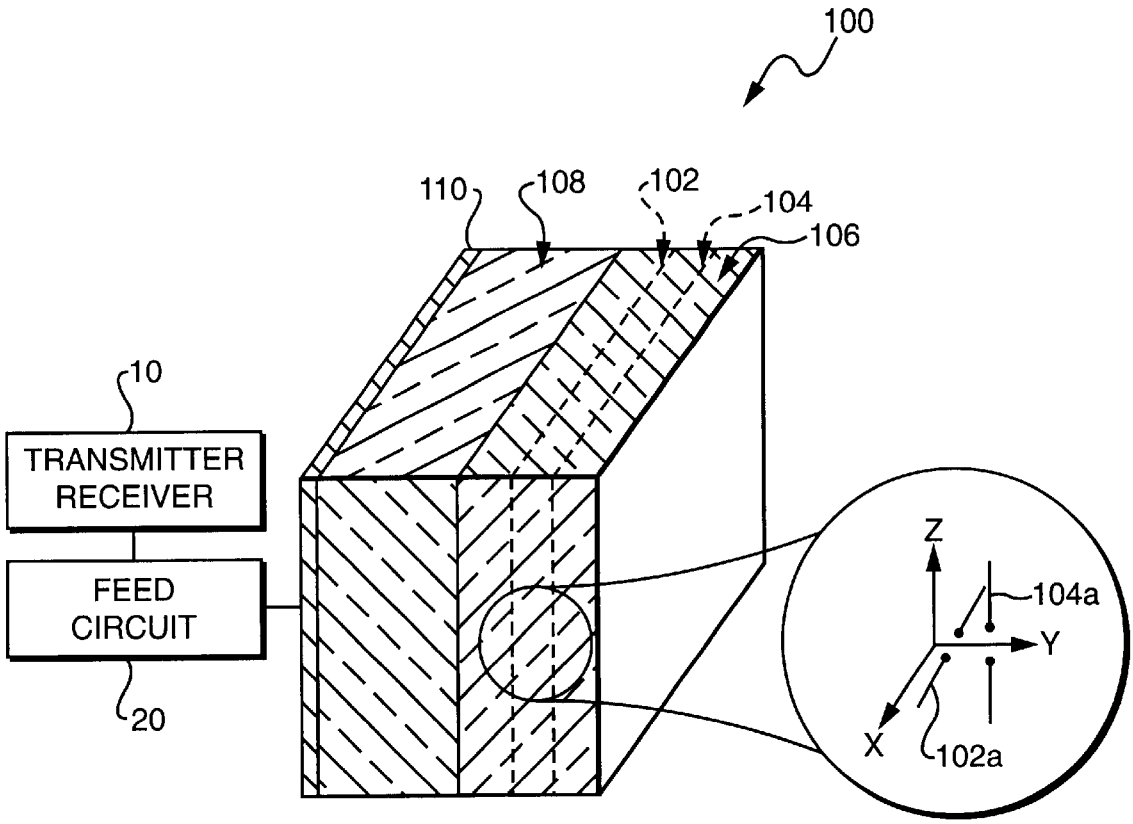
FIGS. 1 and 1A is an illustrated sketch of an antenna according to the invention.

Referring now to FIG. 1, an antenna 100 is shown for an array with a scan impedance that has a minimum variation over a large scan sector, while also maintaining circular polarization (CP). It has long been understood that the antenna impedance of an array experiences a change as the array is scanned. This change occurs as a result of the mutual coupling that exists between the array elements. Although the coupling between two elements is typically a function of their relative position and orientation, the element-to-element phase variation that exists across the plane of the array depends on the direction in which it is scanned (or the direction from which the incident signal arrives). Thus the total impedance, which is the sum of the mutual impedances plus the self impedance, is a function of the scan angle since the mutual impedances are combined with different phases as the array is scanned. The loss of circular polarization as the array is scanned is a direct consequence of the individual element pattern. In general, elements designed to transmit or receive circular polarization (i.e., orthogonal dipoles fed in phase quadrature or helical antennas), can do so only near boresight. Hence an array comprised of such elements experiences a degredation in circular polarization as it is scanned off-boresight.

To overcome the latter, the present invention maintains a minimum scan impedance variation which allows for the load impedance to be conjugate matched over a large scan volume. Only under these conditions is maximum received power delivered to a load. A deviation from perfect circular polarization in the receive pattern will reduce the received power. This constitutes polarization loss. The most general deviation from perfect circular polarization is that of a tilted elliptic polarization, which can be decomposed into a perfect right hand circularly polarized (RHCP) and left hand circularly polarized (LHCP) component. The crosspole isolation is defined as the ratio of the desired polarization to the undesired polarization. A low polarization loss is synonymous with a high crosspole isolation. The antenna 100 maintains a low polarization loss throughout this same scan sector. Also, a high crosspole isolation is necessary in order to keep undesired reflected fields from being received by the antenna 100.

The antenna 100 includes two orthogonal planar arrays including horizontal array 102 and vertical array 104 disposed in a general stratified dielectric media 106, 108 backed by a ground plane 110. The two arrays 102, 104 are fed in phase quadrature (i.e., a 90 degrees phase difference is introduced between any given array element and its orthogonal counterpart) with a spacing between them of less than a tenth of a wavelength ($\lambda/10$). The interelement spacings are kept below $\lambda/2$ to eliminate the possibility of onset of grating lobes. The array elements include short straight dipoles. The exterior dielectric slab 106 (the slab adjacent to freespace) serves a dual purpose. The exterior dielectric slab 106, when chosen with the proper thickness and relative dielectric constant, creates an impedance transformation that varies with scan angle in accordance with the arrays natural scan impedance variation. The result is that the array's scan impedance is transformed to near the same value over a large scan sector. At the same time the exterior slab 106 also serves to preserve the circular polarization. The second purpose of the exterior slab 106 is to act as a protective radome against natural elements.

Applications for the antenna 100 include wherever the need for circular polarization reception or transmission over a large scan sector exists. Satellite communication is one such application. Another application is in the reception of telemetry information transmitted from antennas mounted on in-flight missiles. The present invention exhibits some key advantages over antennas currently being used for these applications. Because a scan compensated array is capable of maintaining a low voltage standing wave ratio (VSWR) over a large scan sector, it is a more efficient receive antenna. Only by maintaining a low polarization loss over this same scan sector can this efficiency be sustained. Due to the efficient nature of this design the size of the antenna (and subsequent cost) can be kept to a minimum. In addition, a low VSWR ensures that very little of the received energy is being reflected from the load and re-radiated. For this reason, the present invention also results in a low in-band antenna RCS.

Figure 1A:
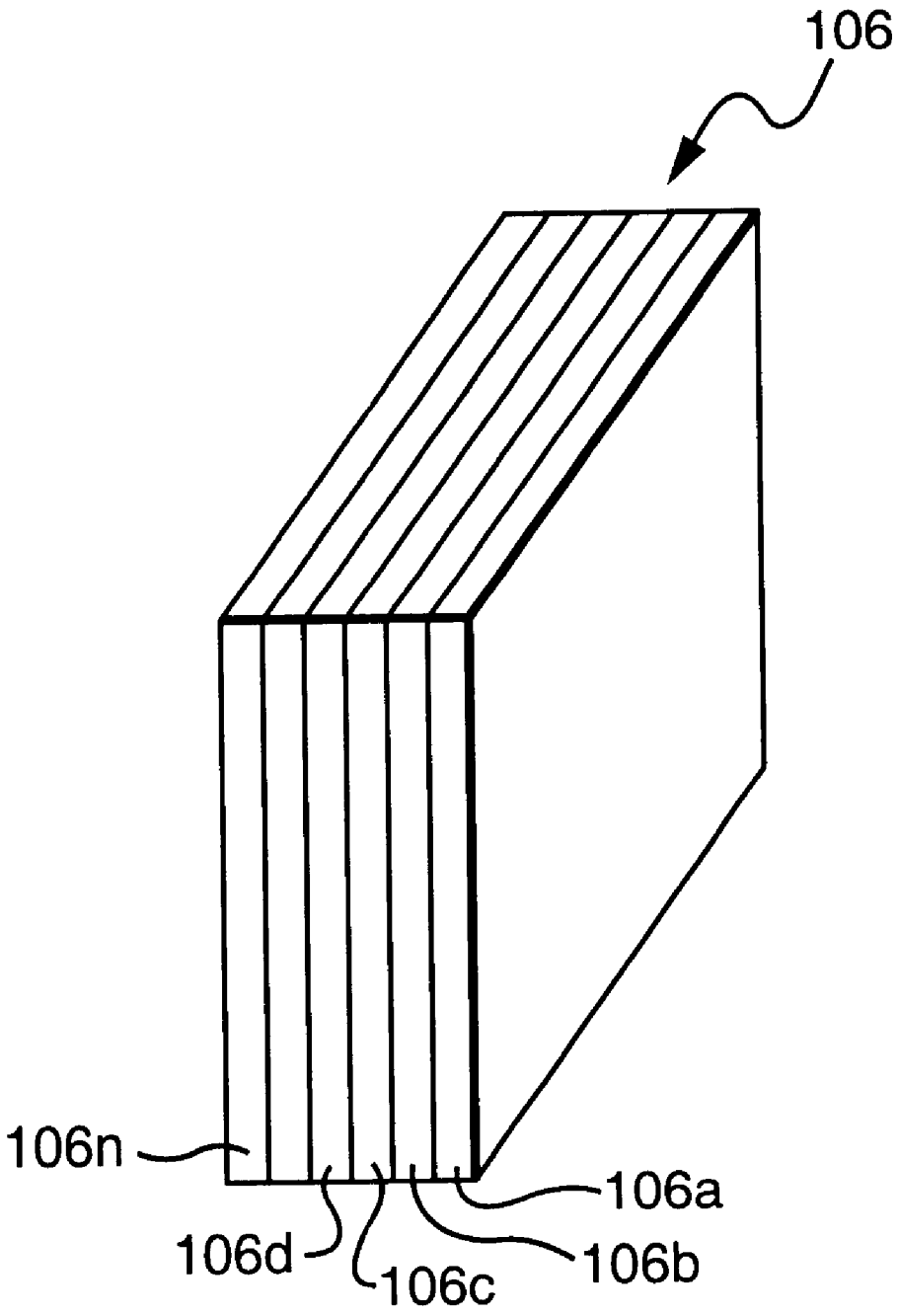

Referring now to FIG. 1A, the general stratified dielectric slab 106 includes a plurality of layers 106*a*–106*n*, here numbered N, wherein increasing the number of layers serves to make the antenna 100 more broadband. Disposed between two of the layers 106*a*–106*n* are dipole-like elements (FIG. 1) having a first polarization (for example horizontal polarization) and disposed between two different layers 106*a*–106*n* are dipole-like elements (FIG. 1) having a second polarization differing from the first polarization by 90 degrees (for example vertical polarization). The dipole-like elements (FIG. 1) having a first polarization and the dipole-like elements (FIG. 1) having a second polarization can be disposed between any of the N layers depending upon the desired impedance. With such an arrangement, circular polarization (CP) can be maintained over scan angles ±70 degrees. Furthermore, the variation of the scan impedance is below a VSWR of 1.3. It is shown that simultaneous scan independence requirements on the circular polarization and scan impedance are not in conflict, but coexist naturally in the antenna 100. Also, the dielectric layers exterior to the array 104 serve as a radome to protect the array 104 and 102. In the following discussion, reference is made to the radiation (i.e., transmit) pattern, where it is understood that this is identical to the receive pattern (via reciprocity). Likewise, the scan impedance applies to the array under either transmit or receive conditions. The array elements 102*a*, 104*a* include straight dipoles lying in the plane of the array. Each element 102*a*, 104*a* is assumed to have a pair of terminals located at its midpoint. The analysis presented hereinafter however is not restricted to this type of element, but can be applied to any element with a known radiation pattern. For the specific case where the dielectric stratified media is comprised of a single or double layer, the theory is extended to include a multiple array configuration. Field and impedance expressions are developed for the double layer configuration where two orthogonal (one with x directed elements and one with z directed elements) planar arrays are imbedded in the outermost (the one adjacent to freespace) slab 106. The two arrays are slightly offset in the y direction and are fed in phase quadrature. It is shown that for the two layer case the thickness and relative dielectric constant of the layer(s) that result in scan independence can be analytically determined. A transcendental equation is developed which leads to these optimal dimensions. It is demonstrated that if this transcendental equation is satisfied and scan independence is achieved, the radiated field will be circular polarization (CP).

Although the methods for achieving scan indepedence described hereinafter apply to any planar array which is embedded in the outermost layer of a general stratified dielectric media 106, for simplicity sake examples are restricted to the one and two layer media. Results are presented which show a scan impedance with a VSWR less than 1.3 and crosspole isolation around 18 dB for scan angles up to and including ±70 degrees from broadside. $An^{ejwt}$ time convention is assumed and suppressed throughout the analysis.

Figure 2:
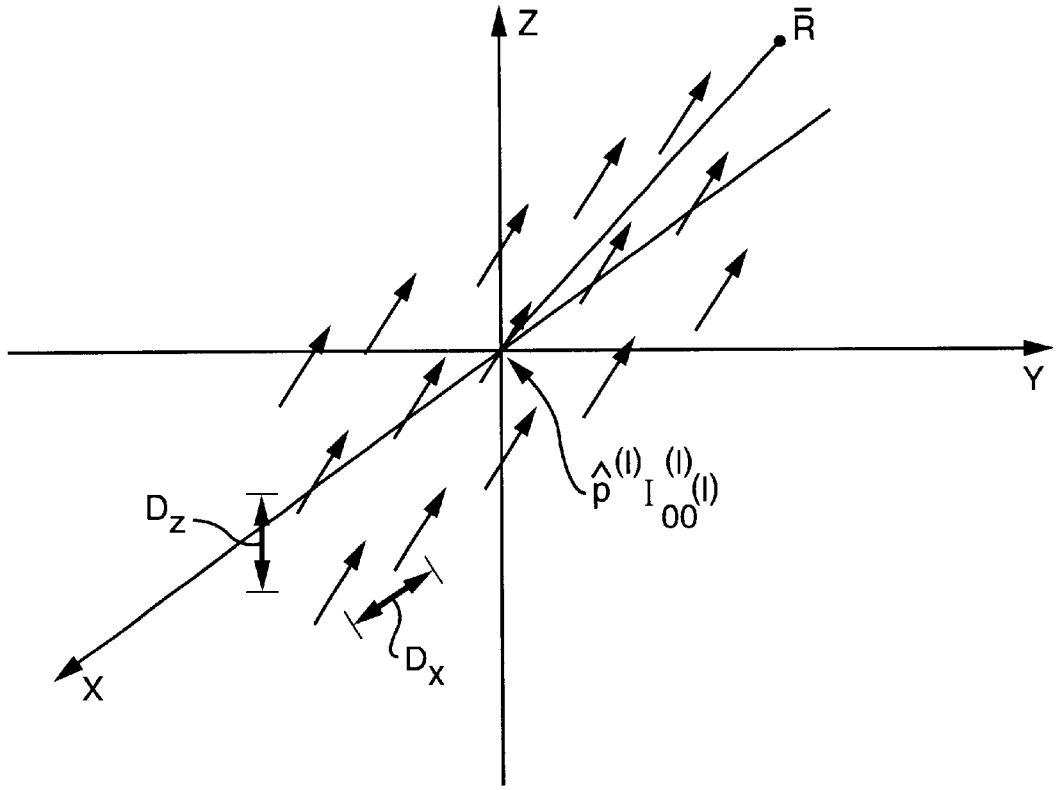
FIG. 2 is a portion of an infinite array in the XZ plane comprised of identical linear elements oriented along the $\hat{p}^{(l)}$ unit vector.

Consider an infinite array of identical, linear elements oriented along the $\hat{p}^{(l)}$ unit vector, lying in the XZ plane as shown in FIG. 2. The current on the element in the qth column and mth row is given by $\hat{p}^{(l)}I_{qm}^{(l)}$. In the present analysis it is assumed that the magnitude of the current on each of the elements is the same, while the phase is such that it matches that of an incident plane wave propagating in the direction $$\hat{s}=\hat{x}s_x+\hat{y}s_y+\hat{z}s_z. \quad \text{Eq. 1}$$

Thus the $I_{qm}^{(l)}$ term can be expressed $$I_{qm}^{(l)}=I^{(l)}(1)e^{-j\beta qD_xs_x}e^{-j\beta qD_xs_z}, \quad \text{Eq. 2}$$

where β is the propagation constant, $D_x$ and $D_z$ the inter-element spacings in the x and z direction respectively, and I(l) (l) is the current on some arbitrarily chosen reference element.

The electric field $\overline{E}^{(l)}(\overline{R})$ radiated at some point $\overline{R}$ from an array configured as such, with the reference element located at $\overline{R}^{(l)}$ is given by $$\overline{E}^{(l)}(\overline{R}) = I^{(l)} \cdot \frac{Z_c}{2D_xD_z}\sum_{k=-\infty}^{+\infty}\sum_{n=-\infty}^{+\infty}\frac{e^{-j\beta(\overline{R}-\overline{R}^{(l)})\cdot\hat{r}_\pm}}{r_y}\overline{e}_\pm^{(l)}P^{(l)} \quad y \gtrless 0, \quad \text{Eq. 3}$$

where $Z_c$ is the characteristic impedance of the surrounding media, and $$\hat{r}_\pm \equiv \hat{x}\left(s_x + k\frac{\lambda}{D_x}\right) \pm \hat{y}r_y + \hat{z}\left(s_z + n\frac{\lambda}{D_z}\right) \quad y \gtrless 0, \quad \text{Eq. 4}$$

$$r_y \equiv \left[1 - \left(s_x + k\frac{\lambda}{D_x}\right)^2 - \left(s_z + n\frac{\lambda}{D_z}\right)^2\right]^{1/2}, \quad \text{Eq. 5}$$

$$\overline{e}_\pm^{(l)} \equiv \left[\hat{p}^{(l)} \times \hat{r}_\pm\right] \times \hat{r}_\pm, \quad \text{Eq. 6}$$

and $P^{(l)}$ is the element pattern given by $$P^{(l)} \equiv \frac{1}{I^{(l)}}\int_{element} I^{(l)}(l)e^{j\beta l\hat{p}\cdot\hat{r}_\pm}. \quad \text{Eq. 7}$$

Figure 3:
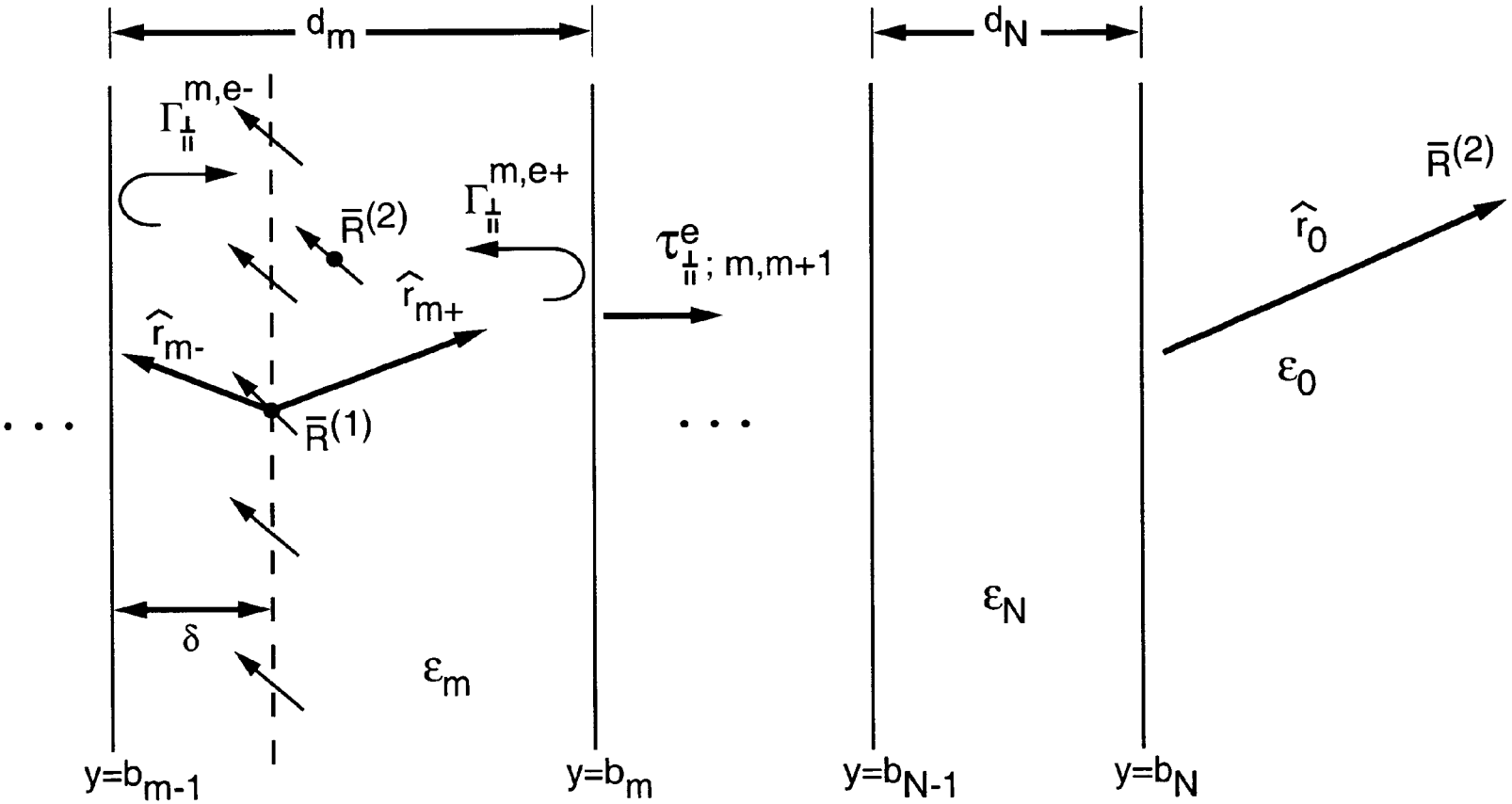
FIG. 3 is a sketch of a general stratified case with an array located in the mth layer of an N layer stratifed dielectric medium.

The physical interpretation of equation (3) is that the field from an infinite array of Hertzian elements consists of an infinite number of plane waves propagating in the direction $\hat{\gamma}\pm$. Inspection of equation (4) reveals that as k and n increase $r_y$, turns purely imaginary, whereby these waves become evanescent. The spectral representation given in equation (3) makes the extension to the case where the array is located in a general stratified medium straight-forward. Consider now that the array is located in a dielectric slab of thickness $d_{rn}$ with a relative dielectric constant $\epsilon_m$ and a propagation constant of $\beta_m$. The slab is located along the y axis between the points $y=b_{m-1}$ and $y=b_m$ within a general stratified medium composed of N layers as illustrated in FIG. 3. The plane wave(s) within the slab propagate to the right and left of the array in the directions $\hat{\gamma}_{m+}$ and $\hat{r}_{m-}$ respectively (where it is understood that $\hat{\gamma}_{m\pm}$ are functions of n and k). At this point it is useful to introduce the concept of effective reflection and transmission coefficients. These are defined as the ratio of the total reflected and transmitted fields at a given interface within the stratified medium to the incident field at that interface. Using this concept, the field at a point $\hat{R}^{(2)}$ to the right of the array but within the same slab may be written $$\overline{E}(\overline{R}^{(2)}) = -I_m^{(l)} \cdot \frac{Z_m}{2D_xD_z} \sum_{k=-\infty}^{+\infty} \sum_{n=-\infty}^{+\infty} \frac{e^{-j\beta_m(\overline{R}^{(2)}-\overline{R}^{(l)})\cdot\hat{r}_{m+}}}{r_{m,y}} \cdot \left[\hat{n}_\perp^{m+} P_\perp^{m(l)}\left(1+\Gamma_\perp^{m,e-} e^{-j2\beta_m(y^{(l)}-b_{m-1})r_{m,y}}\right) \cdot \left(1+\Gamma_\perp^{m,e+} e^{-j2\beta_m(b_m-R_y^{(2)})r_{m,y}}\right) \cdot W_\perp^{me} + \hat{n}_\parallel^{m+} P_\parallel^{m(l)}\left(1+\Gamma_\parallel^{m,e-} e^{-j2\beta_m y^{(l)} r_{m,y}}\right) \left(1+\Gamma_\parallel^{m,e+} e^{-j2\beta_m(b_m-R_y^{(2)})r_{m,y}}\right) \cdot W_\parallel^{me}\right], \quad \text{Eq. 8}$$

where $$W_{\substack{\perp\\\parallel}}^{me} \equiv \left[1-\Gamma_{\substack{\perp\\\parallel}}^{m,e-}\Gamma_{\substack{\perp\\\parallel}}^{m,e+}\right]^{-1}, \quad \text{Eq. 9}$$

and $$r_{m,y} \equiv \left[1-\left(s_{m,x}+k\frac{\lambda_m}{D_x}\right)^2-\left(s_{mz}+n\frac{\lambda_m}{D_z}\right)^2\right]^{1/2}, \quad \text{Eq. 10}$$

and $$\Gamma_{\substack{\perp\\\parallel}}^{m,e-} \text{ and } \Gamma_{\substack{\perp\\\parallel}}^{m,e+}$$

represent the effective orthogonal and parallel relection coefficients at the left and right slab interfaces respectively. The form of equation (8) results from the decomposition of the field quantities into components orthogonal and parallel with the plane of incidence where the subscripts ⊥ and ∥ refer to those field quantities associated with the orthogonal and parallel components respectively. The orthogonal and parallel unit vectors are defined in terms of the direction of propagation of the plane wave $\hat{\gamma}_{m+}$ and the normal to the slab interface $\hat{n}_D$ in the following manner $$\hat{n}_\perp^{m+} \equiv \frac{\hat{n}_D \times \hat{r}_{m+}}{|\hat{n}_D \times \hat{r}_{m+}|}; \hat{n}_\parallel^{m+} \equiv \hat{n}_\perp^{m+} \times \hat{r}_{m+}. \quad \text{Eq. 11}$$

The orthogonal and parallel pattern functions $p_{195}{}^{m(l)}$ and $P_{81}{}^{m(l)}$ are defined in terms of the unit vectors $$\hat{n}_{\substack{\perp\\\parallel}}^{m+}$$

as $$P_{\substack{\perp\\\parallel}}^{m(l)} \equiv P^{m(l)}\hat{p}^{(t)} \cdot \hat{n}_{\substack{\perp\\\parallel}}^{m+}. \quad \text{Eq. 12}$$

The voltage $V^{(2)}$ induced on an external element located at $\overline{R}^{(2)}$ oriented in the direction $\hat{p}^{(2)}$, with a current distribution under conditions given by $I^{(2)t}(l)$, may be written $$V^{(2)} = \frac{1}{I^{(2)t}(\overline{R}^{(2)})} \int_{element2} dl' \overline{E}(\overline{R}^{(2)}) \cdot \hat{p}^{(2)} I^{(2)t}(l'). \quad \text{Eq. 13}$$

If the external element is moved to within a wire radius "a" of the reference element, the self impedance can be obtained by dividing through by the array element current $I_m{}^{(l)}(\overline{R}^{(l)})$, whereby it can readily be shown that $$Z_A = \frac{Z_m}{2D_xD_z} \cdot \sum_{k=-\infty}^{+\infty} \sum_{n=-\infty}^{+\infty} \frac{e^{-j\beta_m a r_{m,y}}}{r_{m,y}} [P_\perp^{m(l)} P_\perp^{m(l)t} T_\perp^{m,e} + P_\parallel^{m(l)} P_\parallel^{m(l)t} T_\parallel^{m,e}] \quad \text{Eq. 14}$$

where $$T_{\substack{\perp\\\parallel}}^{m,e} \equiv \frac{\left[1+\Gamma_{\substack{\perp\\\parallel}}^{m,e-} e^{-j2\beta_m(y^{(t)}-b_{m-l})r_{m,y}}\right]\left[1+\Gamma_{\substack{\perp\\\parallel}}^{m,e+} e^{-j2\beta_m(b_{m-}y^{(t)})r_{m,y}}\right]}{1-\Gamma_{\substack{\perp\\\parallel}}^{m,e-}\Gamma_{\substack{\perp\\\parallel}}^{m,e+} e^{-j2\beta_m d_m r_{m,y}}}, \quad \text{Eq. 15}$$

and $p^{m(l)t}$ is the transmit pattern function defined as $$P^{(l)t} \equiv \frac{1}{I^{(2)t}(\overline{R}^{(2)})} \int_{element} I^{(2)t}(l) e^{-j\beta_m l \hat{p}^{(2)}\cdot\hat{r}_m}. \quad \text{Eq. 16}$$

In order to examine the radiation pattern of the embedded array the field point $\overline{R}^{(2)}$ is moved outside of the stratified medium and into the "far field" of the semi-infinite media which bounds the stratified medium. Employing the same methods used to develop equation (8), the far field radiation pattern $\overline{E}_{ff}(\overline{R}^{(2)})$ may be expressed as $$\overline{E}_{ff}(\overline{R}^{(2)}) = -I_m^{(l)} \cdot \frac{Z_m}{2D_xD_x} \sum_{k=-\infty}^{+\infty} \sum_{n=-\infty}^{+\infty} \frac{e^{-j\beta_m-(\hat{y}b_m-\overline{R}^{(l)})\cdot\hat{r}_{m+}}}{\tau_{m,y}} \cdot \left[\hat{n}_\perp^{0+} P_\perp^{m(l)} \overline{T}_{\perp,m}^{e,<} \tau_{\perp;m;m+1}^e \ldots \tau_{\perp;N,0}^e + \hat{n}_\parallel^0 + P_\parallel^{m(l)}\left(\frac{r_{m,y}}{r_{0,y}}\right) \overline{T}_{\parallel,m}^{e,<} \tau_{\parallel;m,m+1}^e \ldots \tau_{\parallel;N,0}^e\right] \cdot e^{-j\beta_{m+1}d_{m+1}r_{m+1,v}} \ldots e^{-j\beta_N d_N \tau_{N,v}} e^{-j\beta_0(\overline{R}^{(2)}-\hat{y}b_N)\cdot\hat{r}_{O+}}, \quad \text{Eq. 17}$$

for $$\tilde{T}^{e,<}_{\substack{\perp\\\parallel}m} \equiv \left(1+\Gamma^{m,e-}_{\substack{\perp\\\parallel}} e^{-j2\beta_m(R_V^{(l)}-b_{m-1})r_{m,V}}\right) W^{me}_{\substack{\perp\\\parallel}}, \quad \text{Eq. 18}$$

where the $$\tau^{e}_{\substack{\perp\\\parallel};m,m+1}$$

represent the effective orthogonal and parallel transmission coefficients associated with the interface between the mth and (m+1)th slab, defined below in terms of the effective reflection coefficients $$\Gamma^{m+1,e+}_{\substack{\perp\\\parallel}} \text{ and } \Gamma^{m+1,e-}_{\substack{\perp\\\parallel}}$$

as $$\tau^{e}_{\substack{\perp\\\parallel};m,m+1} \equiv \frac{\tau_{\substack{\perp\\\parallel};m,+}}{1-\Gamma^{m+1,e+}_{\substack{\perp\\\parallel}}\Gamma^{m+1,e-}_{\substack{\perp\\\parallel}} e^{-j\beta_{m+1}d_{m+1}\tau_{m+1,y}}} \quad \text{Eq. 19}$$

as
where $$\tau_{\perp;m,+} \equiv \frac{2Z_{m+1}\tau_{m,y}}{Z_{m+1}\tau_{m,y}+Z_m\tau_{m+1,y}}; \quad \text{Eq. 20}$$

$$\tau_{\parallel;m,+} \equiv \frac{2Z_{m+1}\tau_{m+1,y}}{Z_{m+1}\tau_{m+1,y}+Z_m\tau_{m,y}}.$$

EXAMPLE

Two Layer Medium

Having established the form of the scan impedance and radiated fields pertaining to an array embedded in a general stratified dielectric medium, it is a simple matter to develop the scan impedance and radiated field expressions for the specific case of a two layered stratified medium backed on one side by a ground plane. There are several reasons for considering this particular configuration. To begin, the physical principles involved are more easily identified and understood in this simpler configuration. Secondly the simplicity of the scan impedance and radiated field expressions (compared with the general case) offer a greater chance of analytically determining the optimum thickness and relative dielectric for scan independence. Lastly, from a practical standpoint a simple single or double layer design is more cost effective and less labor intensive than a multi-layer design. In instances where the primary goal of the design is to achieve broadband performance, the more complicated multi-layered configuration may be necessary.

Figure 4:
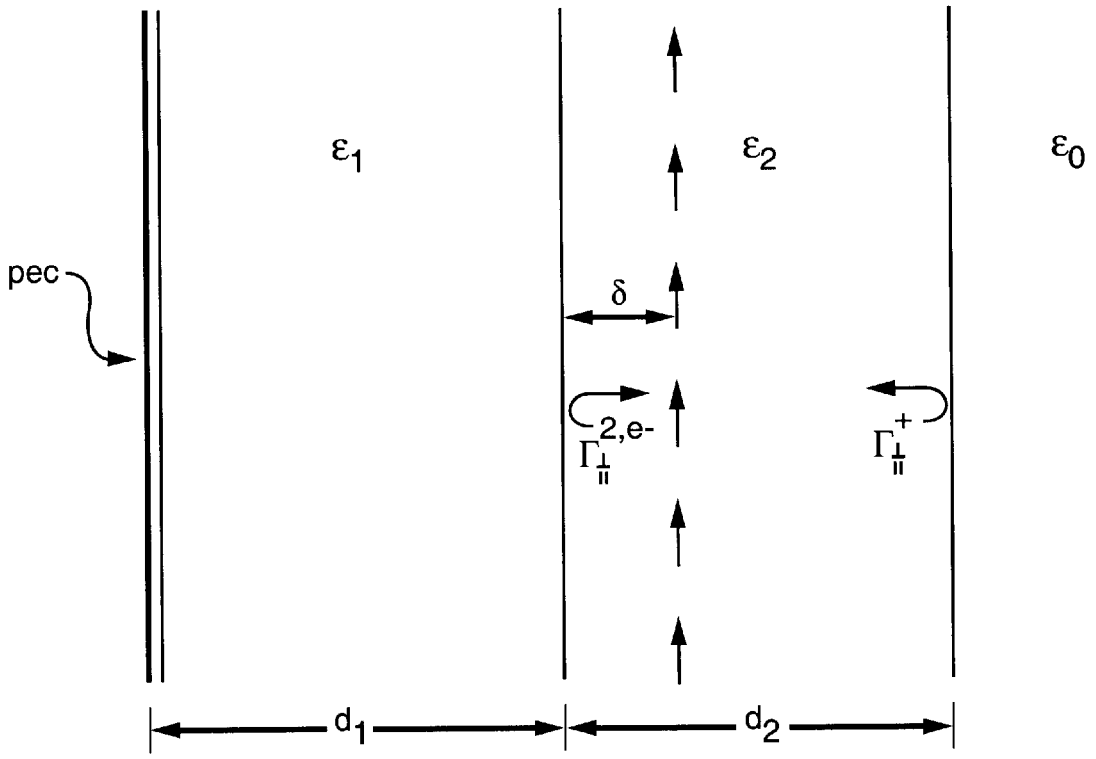
FIG. 4. is a sketch of an array embedded in the front layer of a two layer stratified medium backed by a ground plane.

Consider a planar array comprised of z directed dipoles located in the outer slab (i.e., the slab bounded by free space) of a two slab configuration a distance δ from the interface between two slabs as shown in FIG. 4. The inner slab is of thickness $d_1$ and relative dielectric $\epsilon_1$, and is backed by a ground plane. The outer slab containing the array is of thickness $d_2$with a relative dielectric given by $\epsilon_2$. A second planar array consisting of x directed dipoles is placed α distance a behind the first array. These array elements are fed in phase quadrature with respect to the z directed elements situated in front of them. Using equation (14) the E-plane scan impedance for the z and x directed dipoles $Z_A^z$ and $Z_A^x$ respectively may be written as $$Z_A^z \equiv Z_A^{z,z} + Z_A^{z,x} \quad \text{Eq. 21}$$

and $$Z_A^I \equiv Z_A^{I,I} + Z_A^{I,z} \quad \text{Eq. 22}$$

where $$Z_A^{\zeta,\zeta} = \frac{Z_2}{2D_xD_z}\cdot\sum_{k=-\infty}^{+\infty}\sum_{n=-\infty}^{+\infty}\frac{e^{-j\beta_2 a r_{2,y}}}{r_{2,y}}\left[P_\perp^{\zeta(l)}P_\perp^{\zeta(l)t}T_\perp^{2,e}+P_\parallel^{\zeta(l)}P_\parallel^{\zeta(l)t}T_\parallel^{2,e}\right] \quad \text{Eq. 23} \quad (23)$$

for ζ denoting either x or z, and $$Z_A^{\zeta,\eta} = -\frac{Z_2}{2D_xD_z}\cdot\sum_{k=-\infty}^{+\infty}\sum_{n=-\infty}^{+\infty}\frac{e^{-j\beta_2 a r_{2,y}}}{r_{2,y}}\left[P_\perp^{\zeta(l)}P_\perp^{\eta(l)t}T_\perp^{2,e}+P_\parallel^{\zeta(l)}P_\parallel^{\eta(l)t}T_\parallel^{2,e}\right], \quad (24)$$

where if ζ=z, x, then η=x, z. In the above impedance expressions the transmission terms $T_\perp^{2,e}$ and $T_\parallel^{2,e}$ are defined $$T^{2,e}_{\substack{\perp\\\parallel}} \equiv \tilde{T}^{2,e}_{\substack{\perp\\\parallel}}\cdot\left(1+\Gamma^{+}_{\substack{\perp\\\parallel}} e^{-j\beta_2 r_{2,y}(d_2-\delta)}\right), \quad \text{Eq .25}$$

for $$\tilde{T}^{2,e}_{\substack{\perp\\\parallel}} \equiv \left[1+\Gamma^{2,e-}_{\substack{\perp\\\parallel}} e^{-j\beta_2 r_{2,y}\delta}\right], \quad \text{Eq. 26}$$

with $$\Gamma^{+}_{\perp} \equiv \frac{Z_0 r_{2,y}-Z_2 r_{0,y}}{Z_0 r_{2,y}+Z_2 r_{0,y}}; \qquad \Gamma^{+}_{\parallel} \equiv \frac{Z_0 r_{0,y}-Z_2 r_{2,y}}{Z_0 r_{0,y}+Z_2 r_{2,y}}, \quad \text{Eq. 27}$$

and $$\Gamma^{2,e-}_{\substack{\perp\\\parallel}} \equiv \frac{\Gamma^{2,1}_{\substack{\perp\\\parallel}} - e^{-j\beta_1 r_{1,y}d_1}}{1-\Gamma^{2,1}_{\substack{\perp\\\parallel}} e^{-j\beta_1 r_{1,y}d_1}}, \quad \text{Eq. 28}$$

where $$\Gamma^{2,1}_{\perp} \equiv \frac{Z_1 r_{2,y}-Z_2 r_{1,y}}{Z_1 r_{2,y}+Z_2 r_{1,y}}; \qquad \Gamma^{2,1}_{\parallel} \equiv \frac{Z_1 r_{1,y}-Z_2 r_{2,y}}{Z_1 r_{1,y}+Z_2 r_{2,y}}, \quad \text{Eq. 29}$$

where $Z_1$, $Z_2$, $\beta_1$ and $\beta_2$ represent the characteristic impedance and propagation constant of the inner and outer slab respectively.

$$P^{\zeta(l)}_{\substack{\perp\\\parallel}} \text{ and } P^{\zeta(l)}_{\substack{\perp\\\parallel}}\left(P^{\zeta(l)}_{\substack{\perp\\\parallel}} = P^{\zeta(l)}_{\substack{\perp\\\parallel}} \text{ and } P^{\zeta(l)t}_{\substack{\perp\\\parallel}} = P^{\zeta(l)}_{\substack{\perp\\\parallel}} \text{ for the planar}\right.$$

-continued case being considered here)

represent the orthogonal and parallel element patterns of the z and x directed dipoles respectively, as defined in equation (12) in terms of their element patterns $P^{z(l)}$ and $P^{x(l)}$. These element patterns can be found using equation (7) and are shown below as $$P^{z(l)} = \frac{2\pi L\cos(L/2\beta_z)}{\pi^2 - L^2\beta_z^2};\ \beta_z \equiv \beta_2\cos\theta_2 \quad \text{Eq. 30}$$

$$P^{x(l)} = \frac{2\pi L\cos(L/2\beta_x)}{\pi^2 - L^2\beta_x^2};\ \beta_x \equiv \beta_2\sin\theta_2\cos(\phi_2), \quad \text{Eq. 31}$$

where L denotes the length of the dipoles.

Using equation (17) the electric field radiated from the arrays embedded in the two slab configuration may be expressed $$\overline{E}_{ff}(\overline{R}^{(2)}) = -I_2^{(l)}\cdot\frac{Z_2}{2D_xD_z}\sum_{k=-\infty}^{+\infty}\sum_{n=-\infty}^{+\infty}\frac{e^{-j\beta_2(\hat{y}b_2-\overline{R}^{(l)})\cdot\hat{r}_{2+}}}{r_{2,y}}\cdot \left[\hat{n}_\perp^{0+}\left(P_\perp^{z(l)}\tilde{T}_\perp^{2,e}(\delta) + jP_\perp^{x(l)}\tilde{T}_\perp^{2,e}(\delta_x)\right)\cdot\tau_{\perp;2,0} + \hat{n}_\parallel^{0+}\left(P_\parallel^{z(l)}\tilde{T}_\parallel^{2,e}(\delta) + jP_\parallel^{x(l)}\tilde{T}_\parallel^{2,e}(\delta_x)\right)\left(\frac{r_{2,y}}{r_{0,y}}\right)\tau_{\parallel;2,0}\right]e^{-j\beta_0(\overline{R}^{(2)}-\hat{y}b_2)\cdot\hat{r}_{0+}}, \quad \text{Eq. 32}$$

for $$\delta_x \equiv \delta - \alpha, \quad \text{Eq. 33}$$

where the notation $\tilde{T}_\perp^{2,e}(\delta_x)$ implies that $\delta_x$ is to be used in place of $\delta$ in the expression for $\tilde{T}_\perp^{2,e}$ given in equation 26, and likewise with $\tilde{T}_\parallel^{2,e}(\delta_x)$.

In order to further simplify the analysis the scan impedance and radiated field expressions are now restricted to the E-plane ($\phi=\pi/2$, $0\leqq\theta\leqq\pi$). In addition, it is useful to decompose the scan impedance into the term resulting from the propagating mode(s) and the purely imaginary term that is associated with alt the evanescent modes. Thus, in the E-plane $Z_A^z$ and $Z_A^x$ may be written $$Z_A^z = \frac{Z_2}{2D_xD_z}\cdot\frac{e^{-j\beta_2 a\sin\theta_2}}{\sin\theta_2}\sin^2\theta_2\left(\frac{2L}{\pi}\right)^2\kappa^2 T_\parallel^{2,e} + jX_A^z, \quad \text{Eq. 34}$$

$$Z_A^x = \frac{Z_2}{2D_xD_z}\cdot\frac{e^{-j\beta_2 a\sin\theta_2}}{\sin\theta_2}\left(\frac{2L}{\pi}\right)^2 T_\perp^{2,e} + jX_A^x, \quad \text{Eq. 35}$$

where k is defined $$\kappa \equiv \frac{\cos\left(\beta_2\frac{L}{2}\cos\theta_2\right)}{1-4\left(\frac{L}{\lambda_2}\right)^2\cos^2\theta_2}. \quad \text{Eq. 36}$$

In the above expressions for $Z_A^x$ and $Z_A^x$ it is assumed that the array is designed such that the k=n=0 mode is the only propagating one. Retaining only this mode for the radiated field, in the E-plane $\overline{E}(\overline{R})$ may be expressed $$\overline{E}(\overline{R}) = \frac{Z_2 I_2^{(l)}}{2D_xD_z}\cdot\frac{L}{\pi\sin\theta_2}e^{-j\beta_2\sin\theta_2(d_2-\delta)}e^{-j\beta_2\sin\theta_2(\overline{R}-\hat{y}b_2)\cdot\hat{r}_{0+}} \left[\hat{\phi}\tilde{T}_\perp^{2,e}(\delta_x)\tau_{\perp;2,0} + j\hat{\theta}\sin^2\frac{\theta_2}{\sin\theta_0}\cdot\kappa\cdot\tilde{T}_\parallel^{2,e}(\delta)\tau_{\parallel;2,0}\right]. \quad \text{Eq. 37}$$

For a well designed array, the variation of the $X_A^z$ and $X_A^x$ terms in equations (34) and (35) with respect to scan angle can be kept reasonably small. Thus, focusing on the terms corresponding to k=n=0, it is useful to rewriter $$T_{\substack{\perp\\\parallel}}^{2,e}$$

in the form $$T_{\substack{\perp\\\parallel}}^{2,e} = \frac{T_{+,\substack{\perp\\\parallel}}^{2,e}\cdot T_{-,\substack{\perp\\\parallel}}^{2,e}}{T_{+,\substack{\perp\\\parallel}}^{2,e} + T_{-,\substack{\perp\\\parallel}}^{2,e}} \quad \text{Eq. 38}$$

where $$T_{-,\substack{\perp\\\parallel}}^{2,e} \equiv \frac{1+\Gamma_{\substack{\perp\\\parallel}}^{2,e-}e^{-j\beta_2\delta\sin\theta_2}}{1-\Gamma_{\substack{\perp\\\parallel}}^{2,e-}e^{-j\beta_2\delta\sin\theta_2}} \quad \text{Eq. 39}$$

and $$T_{\substack{\perp\\+,\parallel}}^{2,e} \equiv \frac{1+\Gamma_{\substack{\perp\\\parallel}}^{+}e^{-j\beta_2(d_2-\delta)\sin\theta_2}}{1-\Gamma_{\substack{\perp\\\parallel}}^{+}e^{-j\beta_2(d_2-\delta)\sin\theta_2}}. \quad \text{Eq. 40}$$

Let the k=n=0 term of $Z_A^z$ and $Z_A^x$ be defined as $Z_A^z$ (0,0) and $Z_A^x$ (0,0) respectively, then making use of equation (38)–equation (40), it follows that $$\overset{Z}{Z}_A^x(0,0) = \frac{\overset{Z}{Z}_{A-}^x(0,0)\overset{Z}{Z}_{A+}^x(0,0)}{\overset{Z}{Z}_{A+}^x(0,0)+\overset{Z}{Z}_{A-}^x(0,0)} = \overset{Z}{Z}_{A-}^x(0,0)\,||\,\overset{Z}{Z}_{A+}^x(0,0) \quad \text{Eq. 41}$$

where $$Z_{A\pm}^z(0,0) \equiv \frac{Z_2}{2D_xD_z}\cdot\frac{e^{-j\beta_2 a\sin\theta_2}}{\sin\theta_2}\sin\theta_2\left(\frac{2L}{\pi}\right)^2\kappa^2 T_{\pm,\parallel}^{2,e}(\delta) \quad \text{Eq. 42}$$

-continued $$Z^{x}_{A\pm}(0,0) \equiv \frac{Z_2}{2D_xD_z}\cdot\frac{e^{-j\beta_2 a\sin\theta_2}}{\sin\theta_2}\left(\frac{2L}{\pi}\right)^2 T^{2,e}_{\pm,\perp}(\delta_x). \quad \text{Eq.43}$$

Figure 5:
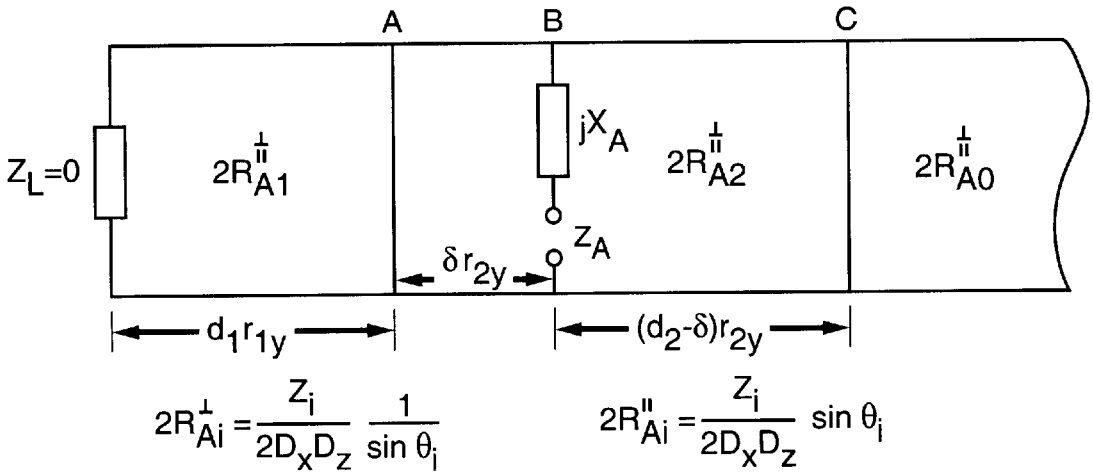
FIG. 5 is an equivalent circuit representation for the scan impedance associated with the k=n=0 term for the two layer example.

The form of equation (41) leads to an equivalent circuit representation for $Z_A^z$ and $Z_A^x$ as shown in FIG. 5. This equivalent circuit representation is extremely useful in determining the optimum design parameters for this configuration which yield a constant scan impedance. Further simplifications are made in the analysis by setting the array separation $\alpha$ to zero. Beginning with the impedance looking to the right of the array (i.e., $Z_{A+}^x$ (0,0) and $Z_{A+}^x$ (0,0)); for scan independence it is necessary that $Z_{A+}^z$ (0,0) be equal to $Z_{A+}^x$ (0,0). This condition must be satisfied since it is required in the present problem that the x and z directed elements individually maintain a constant scan impedance, and thus must have the same scan impedance in the E and H planes. Because the elements are identical, the variation $Z_A^x$ of in the E-plane is equal to the variation Of $Z_A^z$ in the H-plane, and vice versa. For this reason, requiring that the both elements have identical scan impedances in the E and H-plane is equivalent to setting $Z_A^z$ equal to $Z_A^x$ in either of these planes. Enforcing this condition at a given scan angle $\theta_0$ from equation (42) and (43) it can be shown that $$\kappa^2\sin^2\theta_2 T^{2,e}_{+,\parallel} = T^{2,e}_{+,\parallel} \quad \text{Eq. 44}$$

Next, by requiring $$(d_2-\delta) = \frac{\lambda_2}{4\sin\theta_2}, \quad \text{Eq. 45}$$

equation (44) simplifies to $$\sin^2\theta_2 = \frac{\sin\theta_0}{\kappa}. \quad \text{Eq. 46}$$

By making use of the Snell's Law relationship between $\theta_2$ and $\theta_0$, namely $$\theta_2 = \cos^{-1}\left(\frac{\cos\theta_0}{\sqrt{\varepsilon_{r2}}}\right), \quad \text{Eq. 47}$$

the transcendental equation shown in equation (46) can be used to determine the optimum dielectric constant for the outer slab. Thus, using equation (47) in equation (45) the optimum slab thickness is also determined.

Turning now to the left looking impedances $Z_{A-}^z$ (0,0) and $Z_{A-}^x$ (0,0) it is first observed that they are purely imaginary. Choosing $$d_l = \frac{\lambda_1}{4\sin\theta_1}$$

creates an open circuit at junction A in the equivalent circuit as shown in FIG. 5, in which case $$\Gamma^{2,e}_{\substack{\perp\\ \parallel}} = 1.$$

Thus, using equation (39) in equation (42) and equation (43) and setting $Z_{A-}^z$ (0,0)=$Z_{A-}^x$ (0,0) gives the requirement that $\delta$=0. If the dielectric constant of the ground plane backed slab is chosen to be $\epsilon_{r1}$, then the propagation angle $\theta_1$ can be found from the known propagation angle $\theta_2$ via the relationship $$\theta_1 = \cos^{-1}\left(\frac{\sqrt{\epsilon_{r2}}\cos\theta_2}{\sqrt{\epsilon_{r1}}}\right), \quad \text{Eq. 48}$$

from which the thickness of the dielectric slab can be found using the earlier requirement $$d_1 = \frac{\lambda_1}{4\sin\theta_1}.$$

In order to maintain circular polarization (CP) it is necessary that the $\hat{\theta}$ and $\hat{\phi}$ terms in equation (37) be equal. If this condition is enforced as well as requiring that $Z_A^z$ (0,0)=$Z_A^x$ (0,0), the following two equations result, $$T_\perp^{2,e}=\kappa^2\sin^2\theta_2 T_\parallel^{2,e} \quad \text{Eq. 49}$$

and $$\tilde{T}_\perp^{2,e}\tau_{\perp;2,0} = \frac{\sin^2\theta_2}{\sin\theta_0}\cdot\kappa\cdot\tilde{T}_\parallel^{2,e}\tau_{\parallel;2,0}. \quad \text{Eq. 50}$$

A simultaneous solution of equations (49) and (50) yields equation (46). In other words, if the condition in equation (46) is satisfied and the E or H-plane scan impedance associated with the propagating term of the x directed dipole is equal to that of the z directed dipole (i.e., $Z_A^z$ (0,0)=$Z_A^x$ (0,0)), then the radiated field will be circular polarization (CP). The condition given in equation (46) corresponds to a specific scan angle $\theta_0$, and as shown earlier, ensures that at this angle in the E or H-plane the right-looking k=n=0 impedance term associated with the z directed dipole $Z_{A+}^z$ (0,0) is equal to the same term for the x directed dipole $Z_{A+}^x$ (0,0). Therefore, if it is also the case that $Z_{A-}^z$ (0,0)=$Z_{A-}^x$ (0,0) at $\theta_0$, then the condition $Z_{A-}^z$ (0,0)=$Z_{A-}^x$ (0,0) is satisfied. Recalling that the choice of $d_1$ made earlier (i.e.

$$d_1 = \frac{\lambda_1}{4\sin\theta_1}$$

resulted in a left-looking impedance given by an open circuit for both dipoles, the condition $Z_{A-}^z$ (0,0)=$Z_{A-}^x$ (0,0) is indeed satisfied. Thus, for an array configured as such, enforcing the condition in equation (46) results in an equivalence of the scan impedance terms $Z_A^z$ (0,0) and $Z_A^x$ (0,0), which in turn ensure circular polarization. Again it is emphasized that this is at a specific scan angle $\theta_0$, but as the results in the section to follow indicate, these conditions are very nearly satisfied for all angles between boresight and $\theta_0$ as well.

EXAMPLE

The Principal Planes

Figure 6:
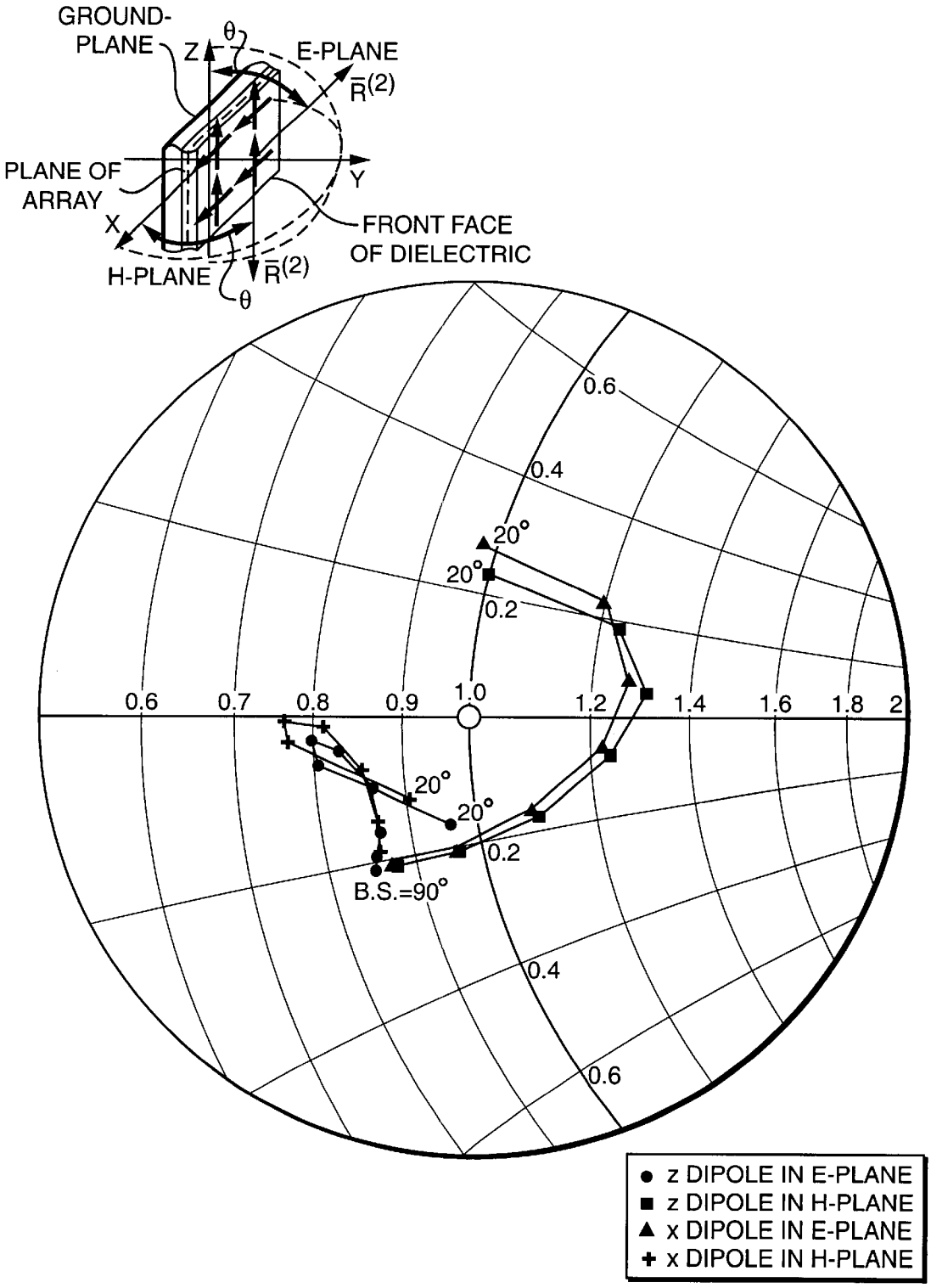
FIG. 6 is a Smith chart showing a double layer configuration of an E-plane and H-plane scan impedance for an array comprised of $\hat{z}$ directed dipoles and comprised of $\hat{x}$ directed dipoles.

Next, two examples are presented which illustrate the scan independent nature of the array design discussed hereinabove. For the first example consider a two layer configuration backed by a ground plane. The outer layer has a thickness of $d_2$=0.432$\lambda_2$ and consists of material with a relative dielectric constant of $\epsilon_{r2}$=1.5. In each array the elements are comprised of short dipoles ($0.35\lambda X_2$), of radius a $=0.01\lambda_2$, with an interelement spacing of $0.36\lambda_2$. The array comprised of the z directed elements is located in the XZ plane at a distance $\delta=0.06\lambda_2$ from the interface between the two slabs, while the array comprised of the x directed elements is located $0.01\lambda$ behind the first array and fed in phase quadrature with respect to it. The second dielectric slab is $0.2765\lambda_2$ thick and has a relative dielectric constant $\epsilon_{r2}=3.0$. In FIG. 6 the scan impedance of each array is plotted in an expanded Smith chart in both the E and H-plane. The VSWR in both these planes is shown in FIG. 7.

Figure 7:
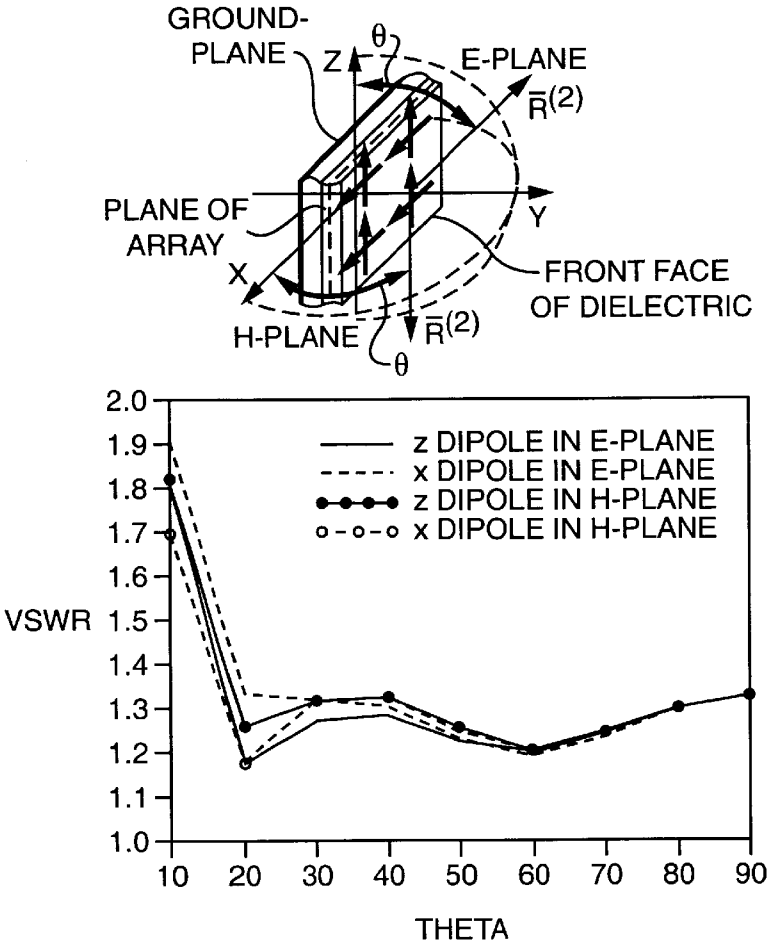
FIG. 7 is a sketch of a double layer configuration scan impedance VSWR for the array comprised of $\hat{z}$ directed dipoles and comprised of $\hat{z}$ directed dipoles in the E-plane and H-plane.

In FIG. 7, the angle $\theta$ is measured from the z axis in the E-plane and the x axis in the H-plane. The results show that for scan angles up to 70° from boresight (i.e., $\theta=20°$) the VSWR for both arrays is kept below 1.35. Without dielectric (assuming the dipoles are placed a distance $d=\lambda/4$ over the ground plane) the VSWR exceeds 4.5 at a scan angle of 60°, and increases to just over 12 when the scan angle reaches 70°. It is noted that the optimum slab thicknesses and relative dielectric constants are determined using the conditions developed hereinabove which assume the array separation a to be zero. The results indicate that the fact that the array separation $\alpha$ is not zero but $0.01\lambda$ is of no great consequence.

Figure 8:
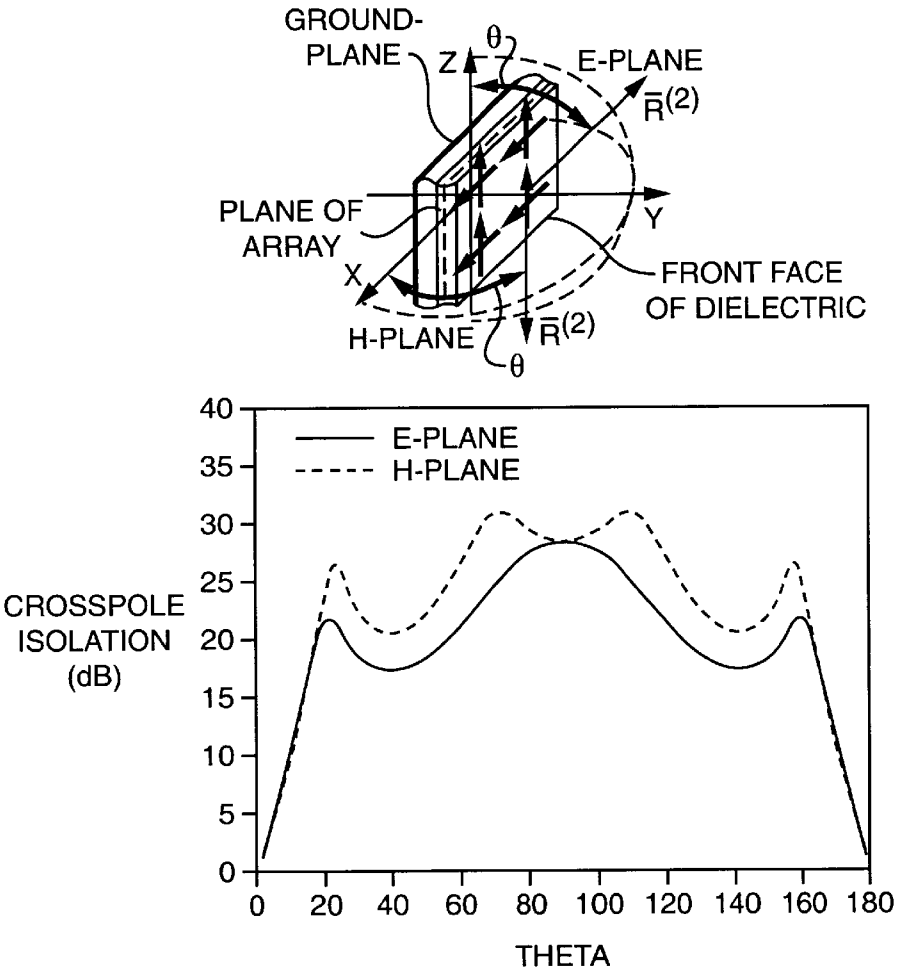
FIG. 8 is a sketch of a double layer configuration crosspole isolation in the E-plane and H-plane.
Figure 9:
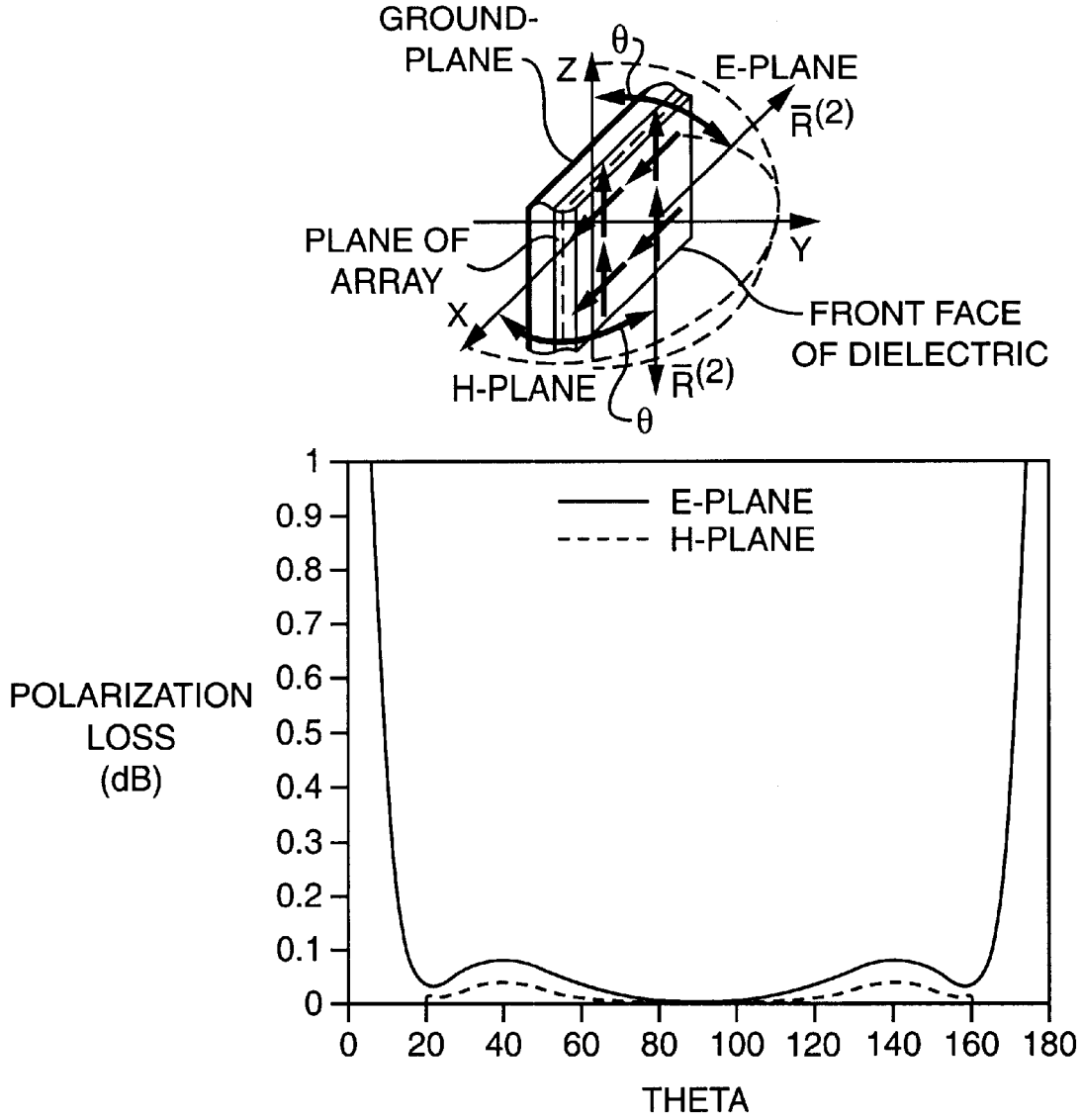
FIG. 9 is a sketch of a double layer configuration polarization loss in the E-plane and H-plane.

Two measures of the degree to which the array maintains its CP reception are given in FIGS. 8 and 9. Any deviation from perfect CP in the array's receive pattern will result in a loss of received signal power. The most general deviation from perfect CP is that of a tilted elliptic polarization, which can be decomposed into a righthand and lefthand CP component. In the present example, the array is designed to receive a lefthand CP wave. In this case the polarization isolation, shown in FIG. 8, is defined as the ratio (in dB) of the lefthand to righthand CP component. The second measure of perfect CP is the amount of power lost due to the imperfect CP receive pattern. This polarization loss is shown in FIG. 9. Again, comparing to the case without dielectric, at a scan angle of 70° the crosspole isolation is reduced to 6 dB and the polarization loss increases to 1.2 dB.

Figure 10:
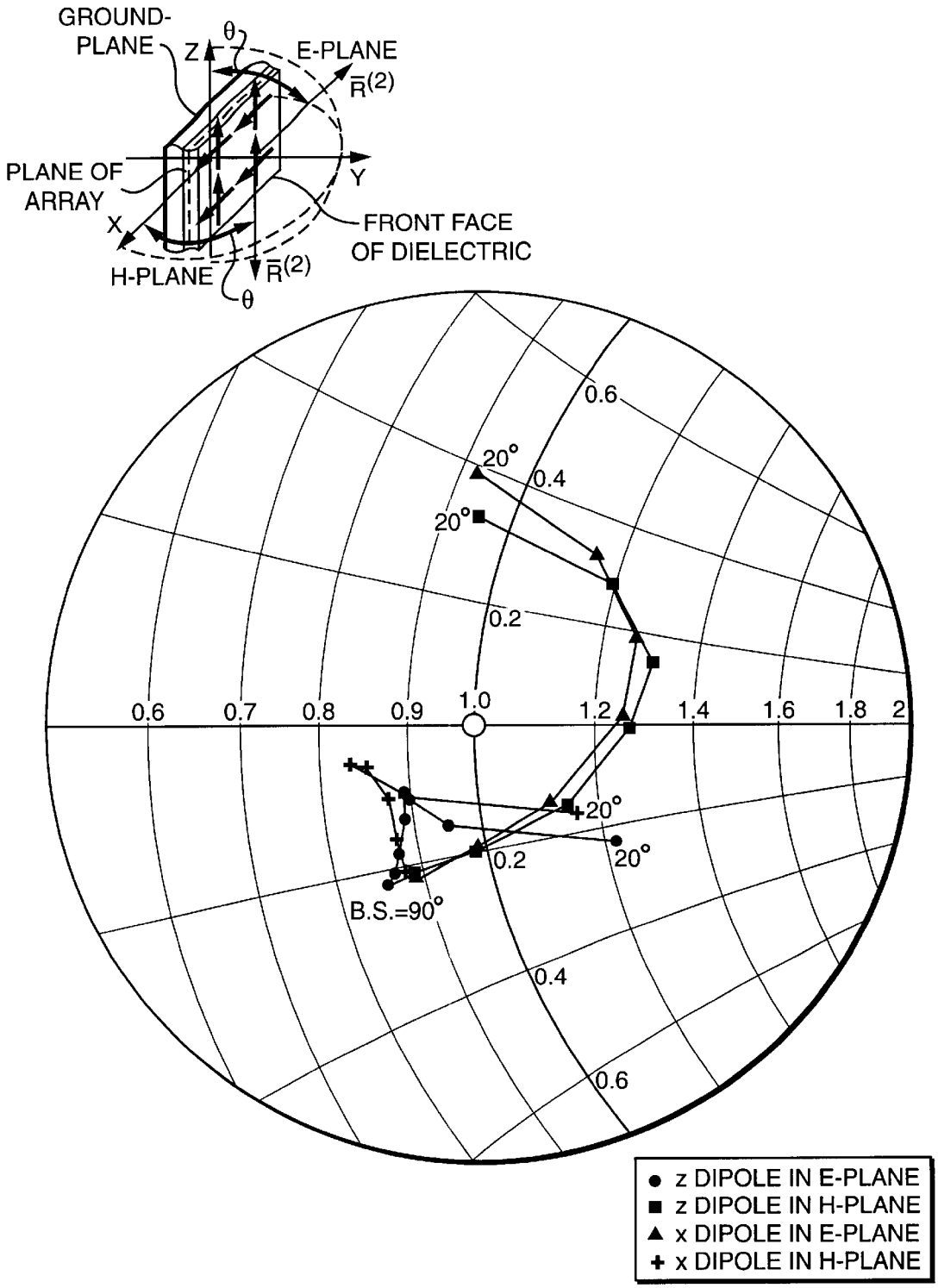
FIG. 10 is a Smith chart showing a single layer configuration of an E-plane and H-plane scan impedance for an array comprised of $\hat{z}$ directed dipoles and comprised of $\hat{x}$ directed dipoles.
Figure 12:
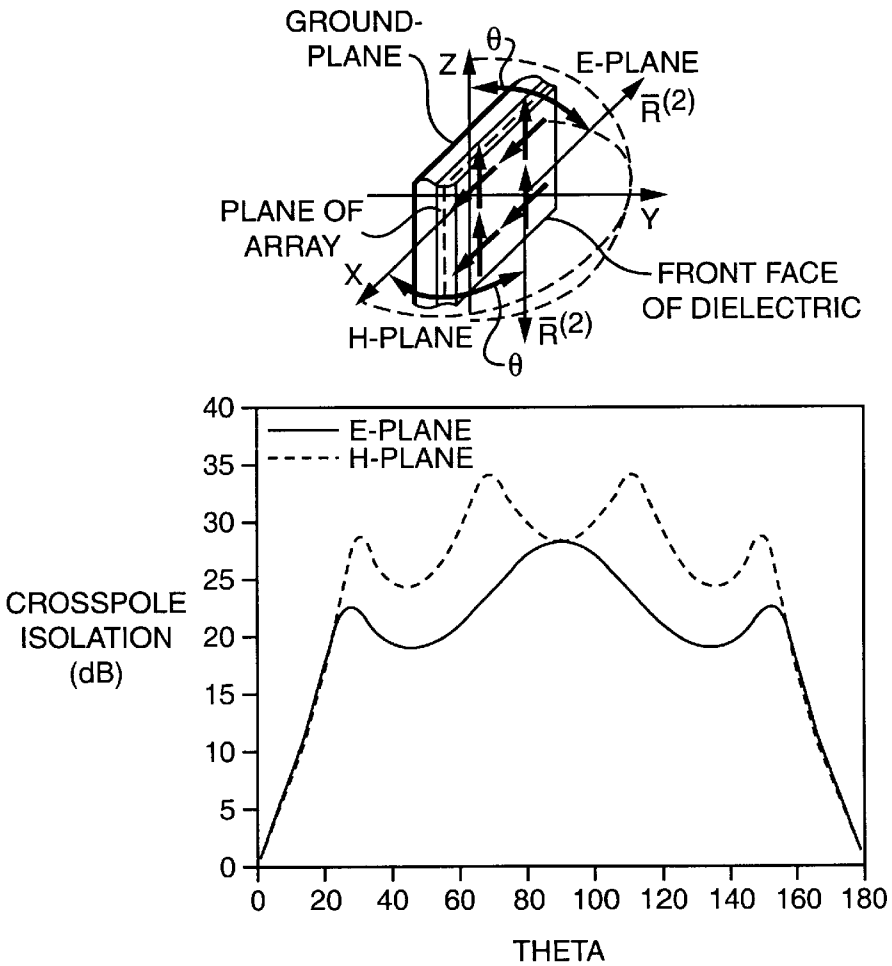
FIG. 12 is a sketch of a single layer configuration crosspole isolation in the E-plane and H-plane.
Figure 11:
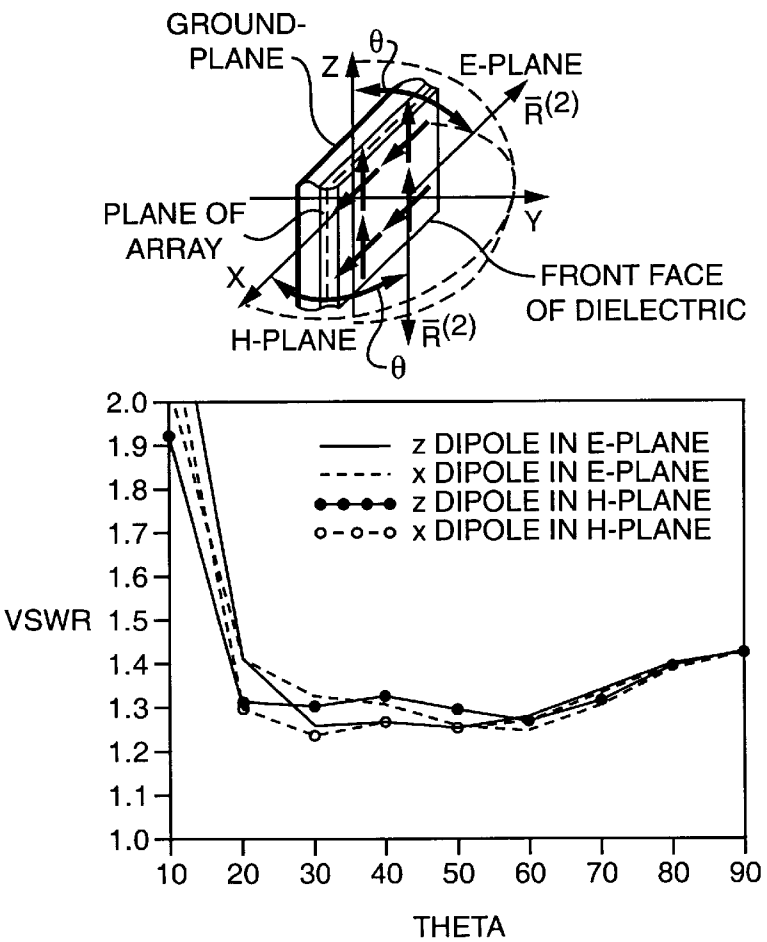
FIG. 11 is a sketch of a single layer configuration scan impedance VSWR for the array comprised of $\hat{z}$ directed dipoles and comprised of $\hat{x}$ directed dipoles.
Figure 13:
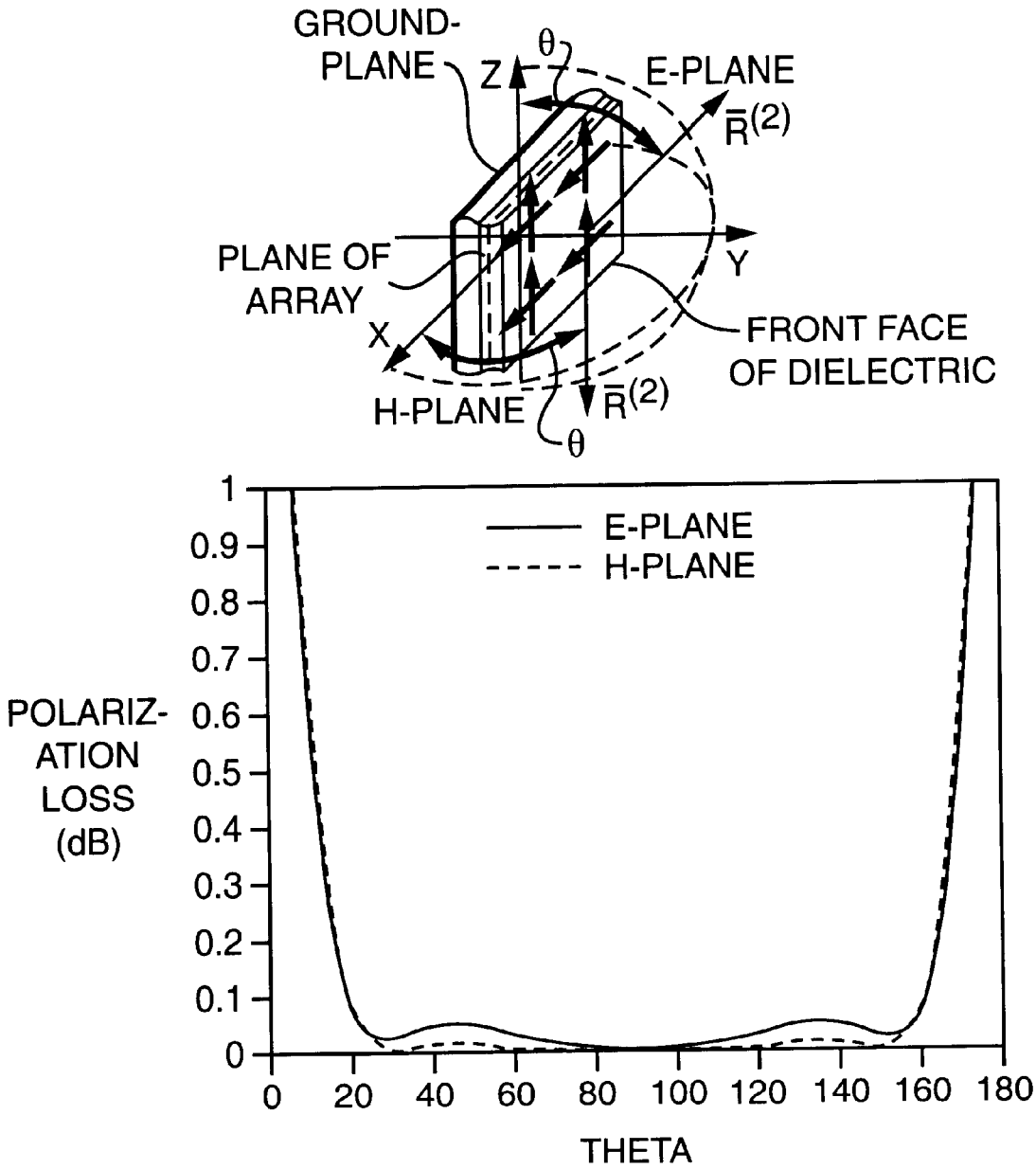
FIG. 13 is a sketch of a single layer configuration polarization loss in the E-plane and H-plane.

The second example is that of a single layer configuration. In this example the ground plane backed dielectric slab is $0.704\lambda_1$ thick, with a relative dielectric constant of $\epsilon_{r1}=1.7$. As in the case of the two layer configuration, equations (44) and (45) are used to determine the relative dielectric constant of the slab and the distance from the plane of the array to the front face ($d_2-\delta$). As in the two layer case, the two arrays do not lie in the same plane, but are slightly offset from one another; the array comprised of z directed elements is located at a distance $\delta$ from the groundplane and the array comprised of x directed elements is located a distance $\alpha=0.10\lambda$ behind it. The optimum slab thickness and relative dielectric constant are again determined using the conditions developed earlier which assume the array separation a to be zero. If the distance $\delta$ is set equal to $$\frac{\lambda_1}{4\sin\theta_2}$$

then the k=n=0 component of the scan impedance looking to the left of the array becomes an open circuit. This is analogous to the two layer example where $$d_1 = \frac{\lambda_1}{4\sin\theta_1}$$

and $\delta=0$. The array elements are identical to those used in the two layer configuration, and are located in the middle of the slab (in the XZ plane) at a distance $\delta=0.352\lambda_1$ from the ground plane. The E-plane and H-plane scan impedance is shown in an expanded Smith chart in FIG. 10. FIG. 11 shows the corresponding VSWR for the scan impedance associated with both arrays. The crosspole isolation and polarization loss are shown in FIGS. 12 and 13 respectively.

A comparison between the single and double layer configuration indicates that the two layer design gives a slightly better performance. For scan angles up to 70° off-boresight a VSWR less than or equal to 1.35 is achieved in the two layer case, whereas the single layer case maintains a VSWR under 1.42. FIGS. 8–9 and 12–13 show that the single layer design has better CP performance than the two layer design until the off-boresight scan angle nears the 70° point.

EXAMPLE

The 45° Intercardinal Plane

Figure 14:
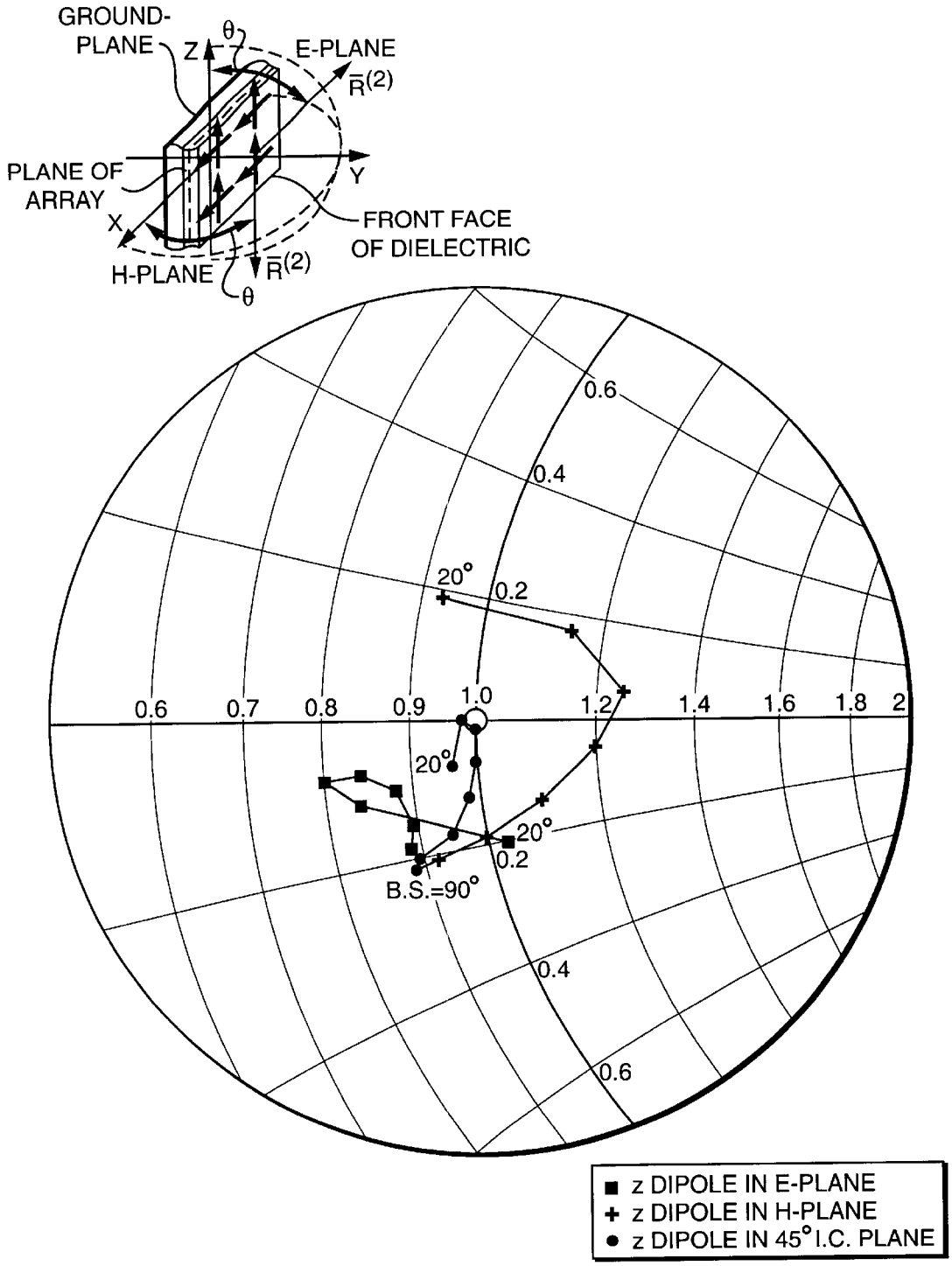
FIG. 14 is a Smith chart showing a double layer configuration scan impedance for an array comprised of $\hat{z}$ directed dipoles in the principal and 45 degrees intercardinal planes.
Figure 15:
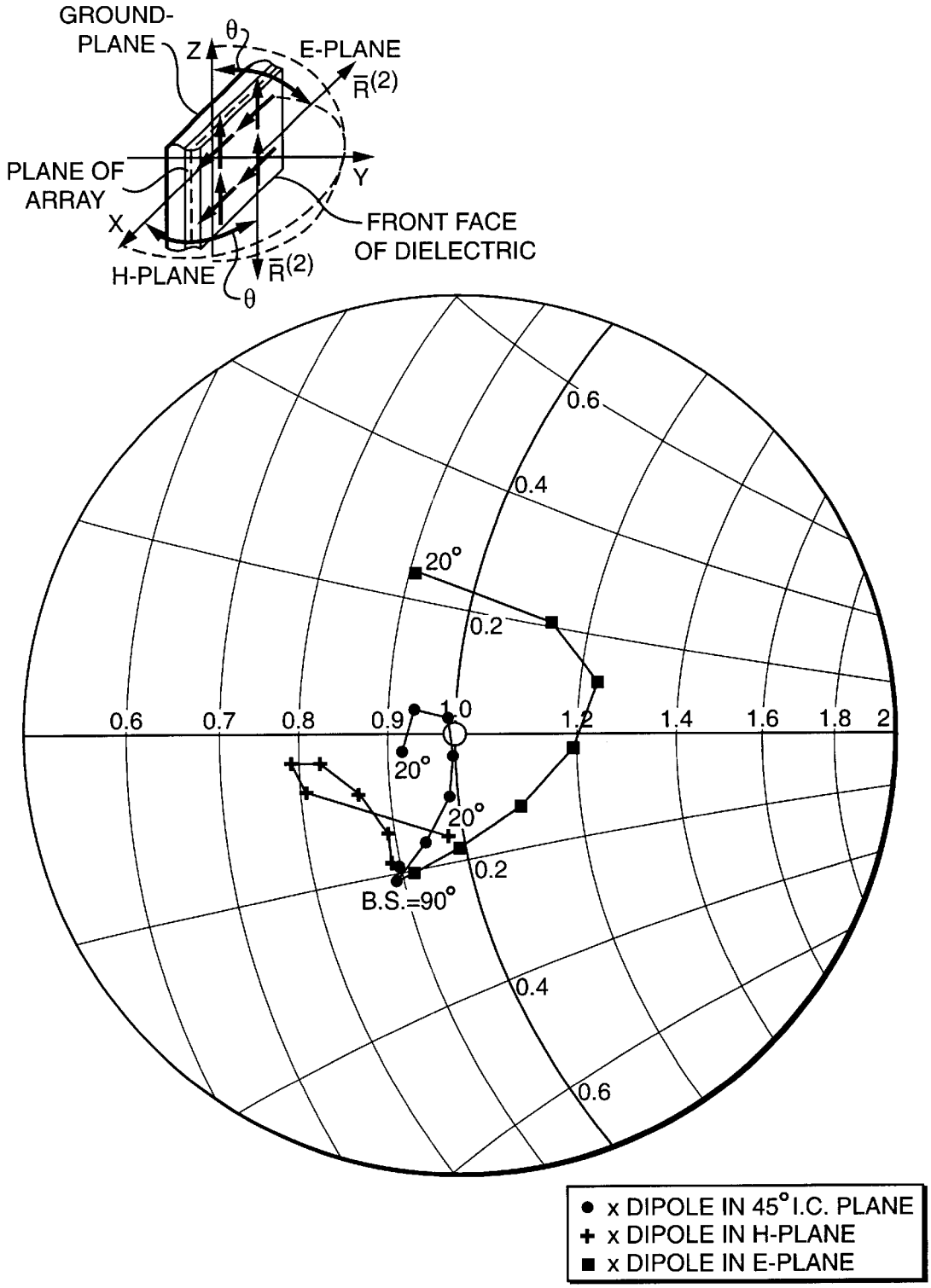
FIG. 15 is a Smith chart showing a double layer configuration scan impedance for an array comprised of $\hat{x}$ directed dipoles in the principal and 45 degrees intercardinal planes.
Figure 17:
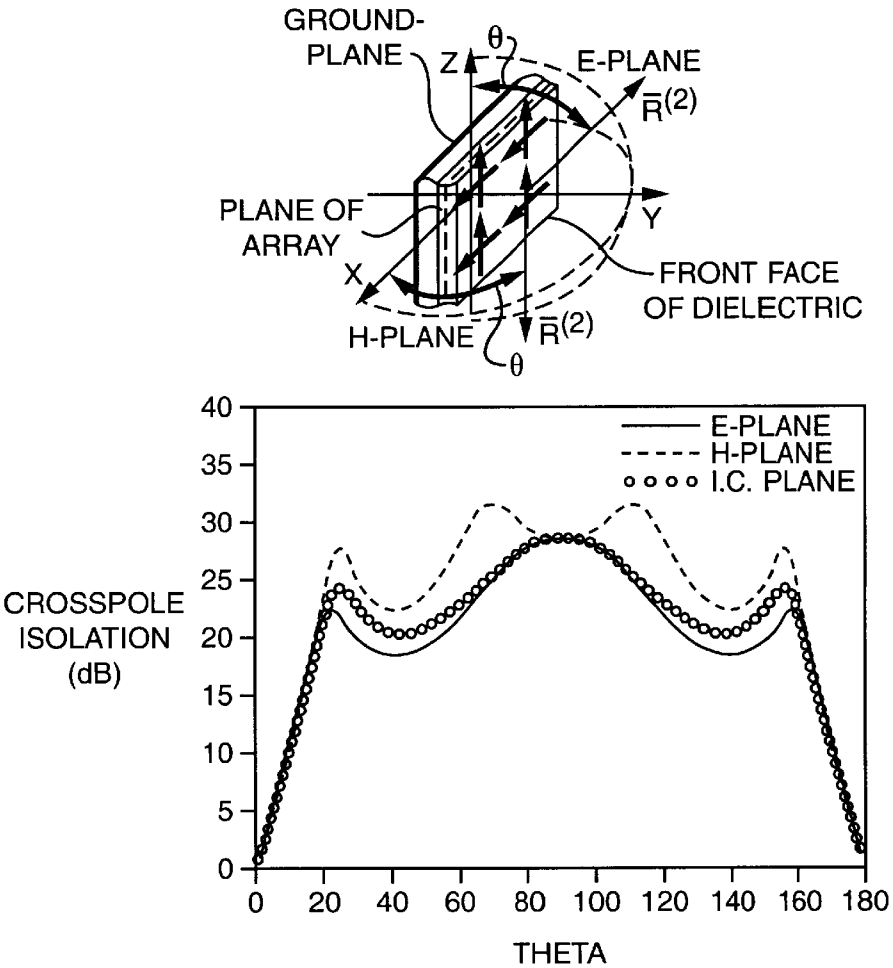
FIG. 17 is a sketch of a double layer configuration crosspole isolation in the principal and 45 degrees intercardinal planes.
Figure 16:
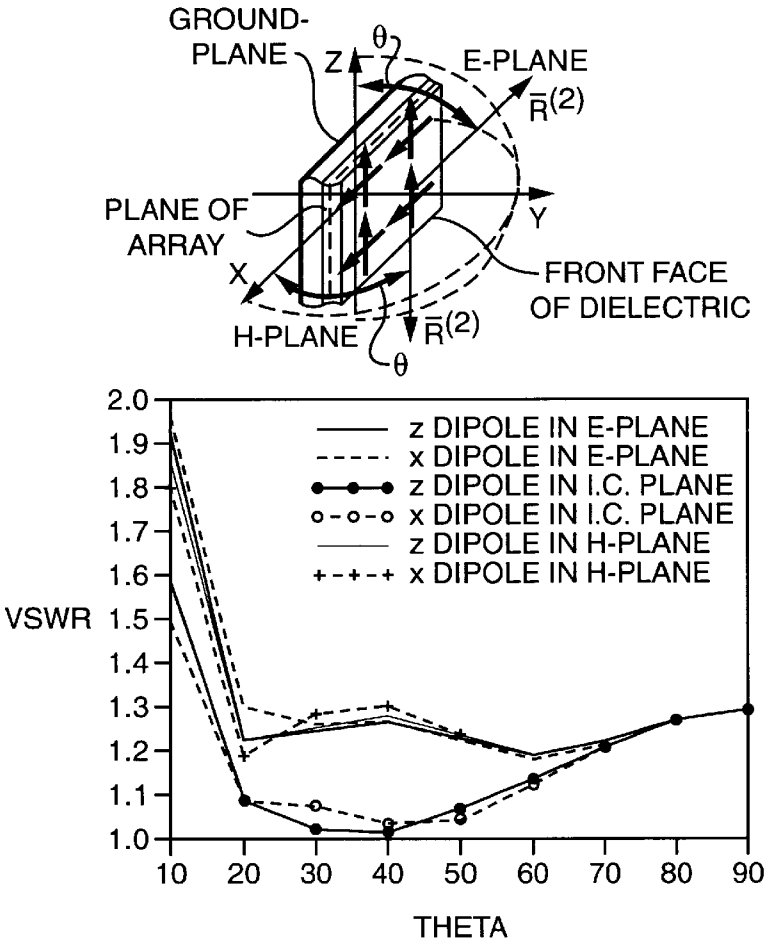
FIG. 16 is a sketch of a double layer configuration scan impedance VSWR for the array comprised of $\hat{z}$ directed dipoles and comprised of $\hat{x}$ directed dipoles in the principal and 45 degrees intercardinal planes.
Figure 18:
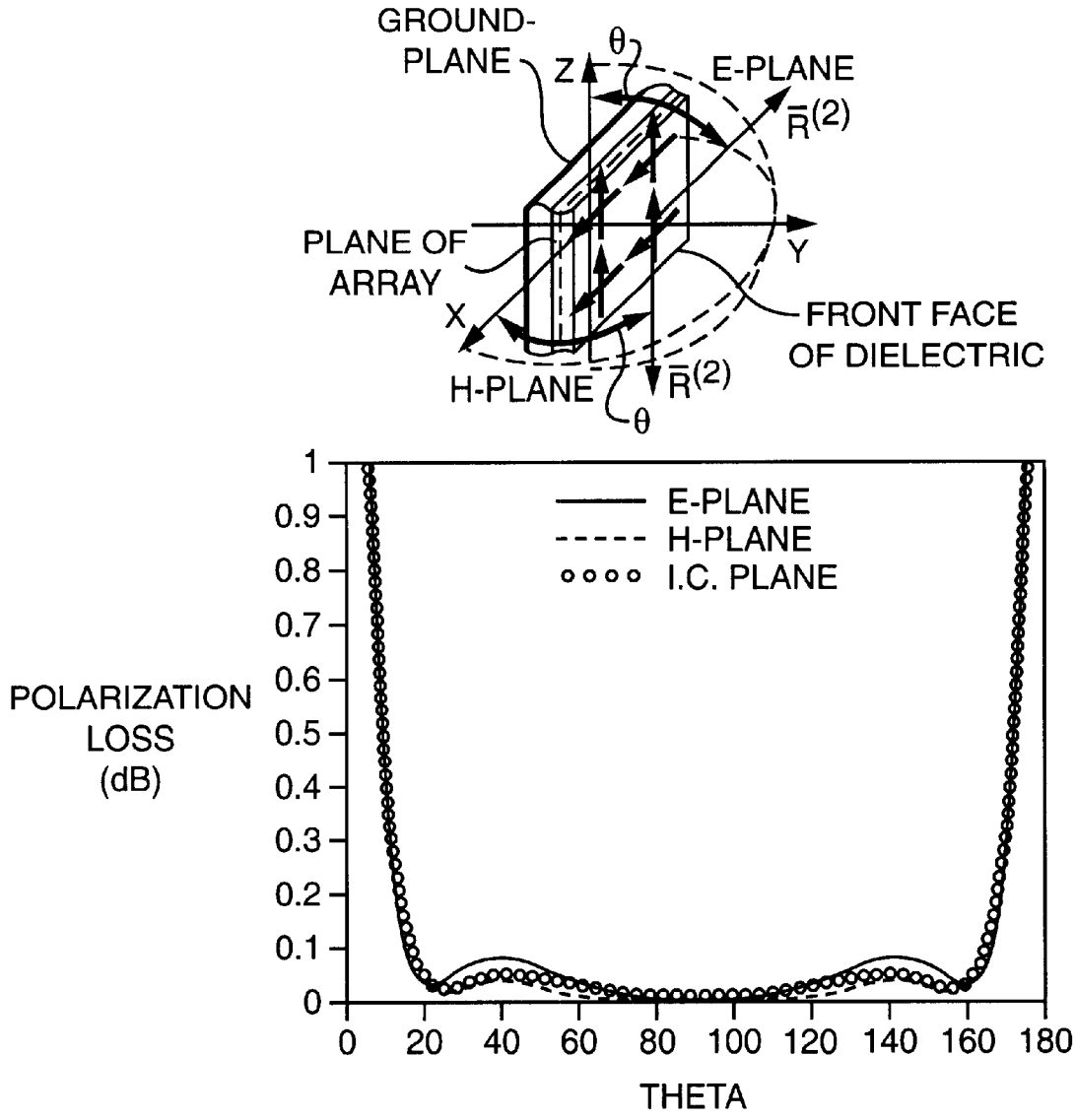
FIG. 18 is a sketch of a double layer configuration polarization loss in the principal and 45 degrees intercardinal planes.

Because the constraining equations used to determine the optimum physical parameters (i.e., slab thickness and relative dielectric constant) in the array design are derived from the field and scan impedance expressions in the principal planes, the desired array performance is expected in these planes. The results presented earlier in this section demonstrate this. That the same level of performance will be maintained outside of the principal planes is not obvious. To illustrate this point the intercardinal plane (at 45°) is chosen as an example case since the field and scan impedance expressions deviate furthest from their respective principal plane counterparts in this plane. Preliminary intercardinal plane results for the double layer design presented earlier indicated that there was insufficient crosspole isolation. By making some minor modifications to the front dielectric slab; decreasing the thickness from $0.432\lambda_2$ to $0.413\lambda_2$ and increasing the relative dielectric $e_{r1}$ from 1.5 to 1.55, a high level of performance can be obtained in both the principal and intercardinal planes. FIGS. 14 and 15 show the scan impedance in an expanded Smith chart for the array comprised of the $\hat{z}$ and $\hat{x}$ dipoles respectively in the principal and intercardinal planes. The resultant VSWRs are shown in FIG. 16. It is noted that after making minor modifications in the thickness and relative dielectric constant of the outermost layer in order to accommodate the intercardinal plane, the resultant VSWR improved slightly in all planes. It is now observed that the VSWR in all planes is below 1.3. The crosspole isolation and polarization loss however remain relatively unchanged, as illustrated in FIGS. 17 and 18 respectively.

It should now be appreciated a technique has been presented for use in the design of arrays that require a constant scan impedance and circular polarization reception over an extended scan volume. The design includes a pair of planar arrays embedded in a general stratified dielectric medium backed by a ground plane. The array elements include linear dipoles. The elements of one array are oriented in the $\hat{z}$ direction, while the elements of the second array are pointed along the $\hat{x}$ direction and are fed in phase quadrature with respect to the elements of the first array. The two arrays lie in the XZ plane and are separated by a distance $\alpha$.

It is well known that an antenna comprised of two orthogonal dipoles fed in phase quadrature is capable of circular polarization (CP) transmission and reception along the bore-sight direction (i.e., in the direction orthogonal to both dipoles). However, when used in an array configuration a rapid degradation of this capability is in evidence as the array is scanned off-boresight. A second, and more widely discussed problem afflicting array elements as they are scanned is that of scan impedance variation. For an array located in a homogeneous medium, a simple short linear array element has dramatically different scan impedance variations in the E and H-plane; in the H-plane the impedance varies approximately as $$\frac{1}{\cos\theta}$$

where $\theta$ is the off- boresight scan angle), and as $\cos\theta$ in the E-plane. A single and double layer design were presented which illustrate these features. The double layer design maintains a VSWR below 1.3 in both principal planes as well as the intercardinal plane for scan angles up to and including ±70° from broadside, while maintaining a cross-pole isolation just under 18 dB.

A transcendental equation that leads to the specific slab thickness and relative dielectric constant that achieve this scan independent behavior has been derived for the specific case of the one and two layer design. This equation represents a more accurate design constraint than known equations. The equation considers scan impedance as well as taking into consideration the polarization nature of the radiated fields as well. A single or double layer design that stems from enforcing this constraining equation represents a very good initial design, but improvements can undoubtedly be obtained by use of an optimization routine. A moderate amount of "fine-tuning" in the array design (i.e., the slab thicknesses or dielectric constant, as well as the element length, spacing and wire radius) is necessary due to approximations made in the derivation of the constraining equation. The advantage of using a more precise constraining equation is that less fine-tuning is required (i.e, the optimum results are obtained in far fewer steps). Also, in order to effectively use an optimization routine, it is important that the initial design be as close to the optimal design as possible. It is noted that antenna fabrication techniques may differ resulting in additional fine-tuning for a specific technique. The numerical results illustrate the high degree of array performance that can be achieved by simply making use of the analytic expressions and fine-tuning by hand.

It should now be appreciated that an antenna 100 in accordance with the present invention includes first and second arrays 102, 104 spaced apart by a first dielectric slab 106 having a predetermined thickness, each of said first and second arrays provided from antenna elements 102*a* having a linear polarization with the antenna elements in said first array disposed orthogonally to the antenna elements 104*a* in said second array. The antenna further includes a feed circuit 20 coupled to the first and second antenna arrays to provide the first and second antenna arrays having a phase relationship such that the antenna receives and transmits signals having circular polarization and dielectric material 106, 108 having differing characteristics for providing an impedance transformation that varies with scan angle in accordance with the a scan impedance of said antenna thereby providing the antenna having a scan impedance which is substantially the same over a scan sector while at the same time preserving the response characteristic of the antenna to signals having circular polarization. With such an arrangement the impedance of the transmitter/receiver 10 can be essentially conjugate matched to the array scan impedance across a large scan volume, resulting in maximum transmitted/received power. In addition, such an arrangement also maintains near perfect circular polarization over this same scan sector, any deviation from which would produce additional power loss in a transmit/receive signal.

Figure 19:
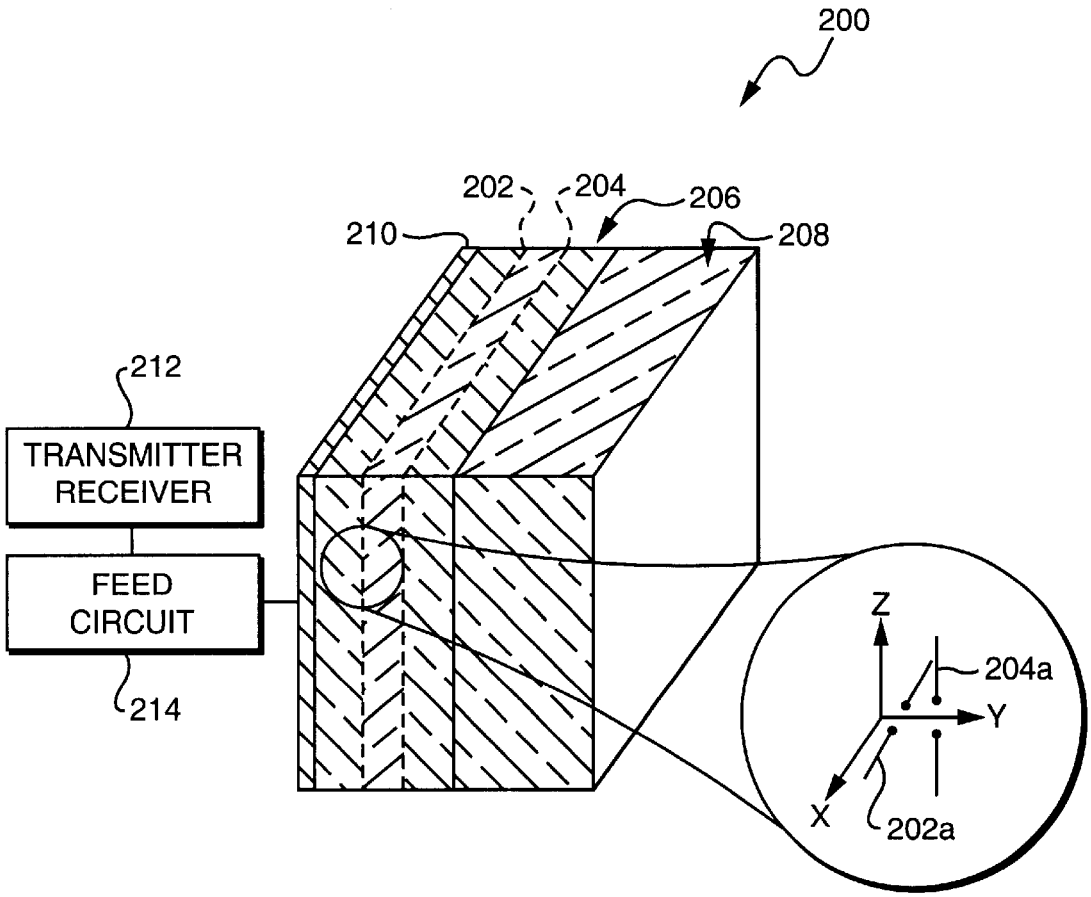
FIG. 19 is an illustrated sketch of an alternate embodiment of an antenna according to the invention.

Referring now to FIG. 19, an antenna 200 includes two orthogonal planar arrays including horizontal array 202 and vertical array 204 disposed in a general stratified dielectric media 206, 208 backed by a ground plane 210. The two arrays 202, 204 are fed in phase quadrature (i.e., a 90 degrees phase difference is introduced between any given array element and its orthogonal counterpart) with a spacing between them of less than a tenth of a wavelength ($\lambda/10$). The interelement spacings are kept below $\lambda/2$ to eliminate the possibility of onset of grating lobes. The array elements include short straight dipoles. The exterior dielectric slab 208 (the slab adjacent to freespace) serves a dual purpose. The exterior dielectric slab 208, when chosen with the proper thickness and relative dielectric constant, creates an impedance transformation that varies with scan angle in accordance with the arrays natural scan impedance variation. The result is that the array's scan impedance is transformed to near the same value over a large scan sector. At the same time the exterior slab 208 also serves to preserve the circular polarization. The second purpose of the exterior slab 208 is to act as a protective radome against natural elements.

A transmitter-receiver 212 couples RF signals to a feed circuit 214 which is effective to couple the RF signals to the first and second antenna arrays to provide a phase relationship such that the antenna receives and transmits signals having circular polarization and dielectric material 206, 208 having differing characteristics for providing an impedance transformation that varies with scan angle in accordance with the a scan impedance of the antenna 200 thereby providing the antenna 200 with a scan impedance which is substantially the same over a scan sector while at the same time preserving the response characteristic of the antenna to signals having circular polarization.

It should now be appreciated that the present invention includes an antenna having a first dielectric layer containing two orthogonal arrays, separated by a distance d, and fed in (or near) phase quadrature. To one side of this slab are one or more dielectric slabs of certain thicknesses and dielectric constants, the last of which (farthest from the slab containing the arrays) is backed by a ground plane. On the other side of this first slab may also exist one or more slabs of predetermined thicknesses and dielectric constants. The thicknesses and dielectric constants of all layers are chosen so as to 1) compensate for the arrays'scan impedance variation, and 2) correct for loss of circular polarization with scan angle.

All publications and references cited herein are expressly incorporated herein by reference in their entirety.

Having described the preferred embodiments of the invention, it will now become apparent to one of ordinary skill in the art that other embodiments incorporating their concepts may be used. It is felt therefore that these embodiments should not be limited to disclosed embodiments but rather should be limited only by the spirit and scope of the appended claims.

What is claimed is:

1. An antenna comprising:

a first plurality of antenna elements having a first orientation and a first non-circular polarization characteristic and arranged to provide a first array antenna;

a second plurality of antenna elements having a second orientation and a second non-circular polarization characteristic and arranged to provide a second array antenna, said second array antenna spaced a predetermined distance from said first array antenna and said second plurality of antenna elements arranged such that the polarization of said first array is orthogonal to the polarization of said second array wherein said first and second array antennas are spaced by a first dielectric slab having first and second opposing surfaces, with said first plurality of antenna elements disposed on the first surface of said dielectric slab and said second plurality of antenna elements disposed on the second surface of said dielectric slab;

a second dielectric slab having a first surface disposed over a second one of the first and second surfaces of said first dielectric slab, said second dielectric slab having a predetermined thickness and relative dielectric constant selected such that said second dielectric slab provides an impedance transformation that varies with scan angle in accordance with a scan impedance of said antenna thereby providing the antenna having said scan impedance which is substantially the same over a scan sector while at the same time preserving the response characteristic of the antenna to signals having circular polarization; and a feed circuit having at least one input port and a plurality of antenna element feed ports, with first ones of said plurality of antenna element feed ports coupled to first ones of said first plurality of antenna elements and second ones of said plurality of antenna element feed ports coupled to first ones of said second plurality of antenna elements and wherein said feed circuit provides a phase relationship between the first ones of said first plurality of antenna elements and the first ones of said second plurality of antenna elements such that the antenna receives and transmits signals having circular polarization as the antenna is scanned over a predetermined range.

2. The antenna as recited in claim 1 further comprising a third dielectric slab having a first surface with a ground plane disposed thereon and second opposing surface disposed over a first one of the first and second surfaces of said first dielectric slab.

3. The antenna as recited in claim 1 wherein the first ones of said first plurality of antenna elements and the second ones of said plurality of antenna elements are provided have a linear polarization characteristic.

4. The antenna as recited in claim 3 wherein the first and second plurality of antenna elements comprise one of: dipole antenna elements and slot antenna elements.

5. The antenna as recited in claim 4 wherein in response to a signal fed to the at least one input port of said feed circuit, said feed circuit provides a signal at each of the first ones of said plurality of antenna element feed ports and a signal at each of the second ones of said plurality of antenna element feed ports and wherein the relative phase between the signal at each of the first ones of said plurality of antenna element feed ports and the corresponding signal at each of the second ones of said plurality of antenna element feed ports is about ninety degrees.

6. The antenna as recited in claim 5 wherein said first and second array antennas are planar array antennas.

7. The antenna as recited in claim 1 wherein said first plurality of antenna elements in said first array antenna are provided having an interelement spacing less than one-half wavelength;

said second plurality of antenna elements in said second array antenna are provided having an interelement spacing less than one-half wavelength; and said first and second array antennas are spaced from said first array antenna by a distance of not more one-tenth of a wavelength.

8. The antenna as recited in claim 1 wherein said feed circuit includes a phase compensation circuit.

9. An antenna comprising:

a first dielectric slab having first and second opposing surfaces;

a ground plane disposed over a first one of the first and second opposing surfaces of said dielectric slab;

a first array antenna having a first polarization characteristic, said first array antenna disposed in said dielectric slab and spaced from said ground plane by a first distance;

a second array antenna having a second polarization characteristic, said second array antenna disposed in said dielectric slab and spaced from said ground plane by a second distance, wherein said second array is disposed such that the polarization characteristic of said second array is orthogonal to the polarization characteristic of said first antenna;

a feed circuit coupled to said first and second antenna arrays to provide said first and second antenna arrays having a phase relationship such that the antenna receives and transmits signals having circular polarization and has an antenna impedance which varies with a scan angle of the antenna; and at least one dielectric slab disposed to compensate for the variation of the antenna impedance with scan angle such that the antenna receives and transmits signals having circular polarization over a range of scan angles.

10. The antenna as recited in claim 9 wherein said feed circuit includes means for feeding the first and second arrays in phase quadrature.

11. The antenna as recited in claim 10 further comprising means for spacing the first array from the second array by a distance not greater than one-tenth wavelength in the dielectric.

12. The antenna as recited in claim 11 wherein:

said first antenna array comprises a first plurality of antenna elements having an interelement spacing selected such that a radiation pattern of said first antenna array does not include grating lobes; and said second antenna array comprises a second plurality of antenna elements having an interelement spacing selected such that a radiation pattern of said second antenna array does not include grating lobes.

13. The antenna as recited in claim 12 wherein said first and second array antennas are planar array antennas.

14. The antenna as recited in claim 9 wherein:

said ground plane is disposed on the first surface of said first dielectric slab;

the first distance is less than the second distance; and the portion of the dielectric slab measured from the plane in which said second array antenna lies to the second surface of the dielectric slab is provided having a thickness and relative dielectric constant selected such that the portion provides an impedance transformation that varies with scan angle in accordance with a scan impedance of said antenna thereby providing the antenna having said scan impedance which is substantially the same over a scan sector while at the same time preserving the response characteristic of the antenna to signals having circular polarization.

15. An antenna comprising:

first and second arrays spaced apart by a first dielectric slab having a predetermined thickness, each of said first and second arrays provided from antenna elements having a linear polarization with the antenna elements in said first array disposed orthogonally to the antenna elements in said second array;

a feed circuit coupled to said first and second antenna arrays to provide said first and second antenna arrays having a phase relationship such that the antenna receives and transmits signals having circular polarization; and means for providing an impedance transformation that varies with scan angle in accordance with a scan impedance of said antenna thereby providing the antenna having said scan impedance which is substantially the same over a scan sector while at the same time preserving the response characteristic of the antenna to signals having circular polarization, said means for providing an impedance transformation comprising a dielectric slab disposed over said first and second arrays, said dielectric slab having a thickness and relative dielectric constant selected to provide the antenna having an impedance transformation that varies with scan angle in accordance with a scan impedance of said antenna thereby providing the antenna having said scan impedance which is substantially the same over a scan sector while at the same time preserving the response characteristic of the antenna to signals having circular polarization.

16. The antenna as recited in claim 15 wherein the antenna elements of said first and second arrays comprise antenna elements having electrical characteristics of a dipole antenna element.

17. The antenna of claim 15 wherein said feed circuit includes a phase compensation circuit.

18. An antenna comprising:

a first dielectric slab having first and second opposing surfaces;

first and second array antennas embedded within said first dielectric slab wherein said first array is a spaced a predetermined distance from the first face of said dielectric slab and the second array is spaced a predetermined distance from first antenna array and wherein each of said first and second array antennas are provided from antenna elements having a linear polarization characteristic with the antenna elements of said first array antenna arranged orthogonally to the antenna elements of said second array antenna and wherein the antenna elements of said first and second array antennas are fed in near phase quadrature such that the antenna is responsive to signals having circular polarization;

one or more second dielectric slabs disposed about the first surface of the first dielectric slab, each of said one or more dielectric slabs having a predetermined thickness and relative dielectric constant; and one or more third dielectric slabs as recited in the second surface of the first dielectric slab, each of said one or more dielectric slabs having a predetermined thickness and relative dielectric constant with a last dielectric slab of the one or more dielectric slabs disposed about the second surface of the first dielectric slab having a ground plane wherein the thickness and dielectric constant of each of the first, second and third dielectric slabs are selected such that the scan impedance of the first and second array antennas and the circular polarization generated by said first and second array antennas is preserved as the antenna is scanned.

19. The antenna of claim 18 wherein said first and second arrays are planar arrays and said antenna elements of each of said first and second array antennas are provided from dipole-like antenna elements.

20. An antenna comprising:

a first dielectric slab having a first surface and a second opposing surface;

a ground plane disposed over the second opposing surface of the first dielectric slab;

a first array of antenna elements having a first polarization characteristic, said first array disposed in said dielectric slab and spaced from said ground plane by a first distance;

a second array of antenna elements having a second polarization characteristic, said second array disposed in said dielectric slab and spaced from said ground plane by a second distance, wherein said second array is disposed such that the polarization characteristic of said second array is orthogonal to the polarization characteristic of said first antenna; and at least one additional dielectric slab disposed over the first surface of the first dielectric slab to compensate for variation of antenna impedance with differing scan angle.

* * * * *

UNITED STATES PATENT AND TRADEMARK OFFICE

CERTIFICATE OF CORRECTION

PATENT NO. : 6,346,918 B1
DATED : February 12, 2002
INVENTOR(S) : Munk

It is certified that error appears in the above-identified patent and that said Letters Patent is hereby corrected as shown below:

Title page,
Item [57], ABSTRACT,
Line 13, delete "with the a scan" and replace with -- with the scan --.

Column 1,
Line 30, delete "its orthogonal" and replace with -- it's orthogonal --.

Column 2,
Line 29, delete "the a scan" and replace with -- the scan --.

Column 3,
Line 3, delete
"$\hat{z}$" and replace with -- $\hat{x}$ --.

Column 4,
Line 15, delete "righthand" and replace with -- right-hand --.
Line 15, delete "lefthand" and replace with -- left-hand --.
Line 31, delete "its" and replace with -- it's --.
Line 35, delete "of onset" and replace with -- of the onset --.

Column 5,
Line 31, delete "its midpoint"and replace with -- it's midpoint --.

Column 6,
Line 13, equation 2, delete "$D_{xsz}$" and replace with -- $D_{zsz}$ --.

Line 56, delete
"$\hat{\gamma}\pm$." and replace with -- $\hat{r}\pm$ --.

Line 67, delete
"$\hat{\gamma}_{m+}$" and replace with -- $\hat{r}_{m+}$ --.

Column 7,
Line 1, delete
"$\hat{\gamma}_{m\pm}$" and replace with -- $\hat{r}_{m\pm}$ --.

Line 7, delete
"$\hat{R}^{(2)}$" and replace with -- $\overline{R}^{(2)}$ --.

UNITED STATES PATENT AND TRADEMARK OFFICE

CERTIFICATE OF CORRECTION

PATENT NO. : 6,346,918 B1
DATED : February 12, 2002
INVENTOR(S) : Munk

It is certified that error appears in the above-identified patent and that said Letters Patent is hereby corrected as shown below:

Column 7 cont'd,
Line 30, equation 10, delete "(s $_{m,x}$+" and replace with -- (s $_{mx}$ + --.

Line 46, delete "$\hat{\gamma}_{m+}$" and replace with -- $\hat{r}_{m+}$ --.

Line 52, delete "$p_{195}{}^{m(1)}$" and replace with -- $P_{\perp}{}^{m(1)}$ --.

Line 53, delete "$P_{81}{}^{m(1)}$" and replace with --$P_{\parallel}{}^{m(1)}$ --.

Column 8,
Line 36, equation 15, delete "$\left(y^{(t)} - b_{m-1}\right)$" and replace with -- $\left(y^{(1)} - b_{m-1}\right)$--.

Line 36, equation 15, delete "$(b_{m-y}{}^{(t)}$" and replace with -- $(b_{m-y}{}^{(1)}$ --.

Line 53, delete "radation" and replace with -- radiation --.

Line 54, equation 17, delete "$\frac{Z_m}{2D_xD_x}$" and replace with -- $\frac{Z_m}{2D_xD_z}$ --.

Column 9,
Line 4, equation 18, delete "$\left(R\frac{(1)}{V} - b_{m-1}\right)r_{m,V}$" replace with -- $\left(R\frac{(1)}{y} - b_{m-1}\right)r_{m,y}$ --.

Line 27, delete "as where" and replace with -- where --.

UNITED STATES PATENT AND TRADEMARK OFFICE

CERTIFICATE OF CORRECTION

PATENT NO. : 6,346,918 B1 
DATED : February 12, 2002
INVENTOR(S) : Munk

It is certified that error appears in the above-identified patent and that said Letters Patent is hereby corrected as shown below:

Column 10,
Line 1, delete "placed α distance a" and replace with -- placed a distance α --.
Line 19, equation 23, delete "(23)".
Line 25, delete "(24)" and replace with -- Eq. 24 --.

Line 65, delete "$P^{z^{(1)}}_{||}\perp$ and $P^{z^{(1)}}_{||}\perp$" and replace with -- $P^{z^{(1)}}_{||}\perp$ and $P^{x^{(1)}}_{||}\perp$ --

Line 65, delete "$P^{z^{(1)}}_{||}\perp = P^{z^{(1)}}_{||}\perp$" and replace with -- $P^{z^{(1)\prime}}_{||}\perp = P^{z^{(1)}}_{||}\perp$ --.

Column 11,
Line 47, delete "alt the" and replace with -- all the --.

Line 66, delete "$Z_A{}^x$ and $Z_A{}^x$" and replace with -- $Z^z_A$ and $Z^x_A$ --.

Column 12,
Line 8, equation 37, delete "$+ j\theta \sin^2 \frac{\theta_2}{\sin\theta_0}$" and replace with -- $+ j\hat{\theta}\frac{\sin^2\theta_2}{\sin\theta_0}$ --.

Line 16, delete "rewriter" and replace with -- rewrite --.

Column 13,
Line 13, delete "$(i.e., Z^x_{A+}(0,0)$" and replace with -- $(i.e., Z^z_{A+}(0,0)$ --.

Line 19, delete "of in" and replace with -- in --.

UNITED STATES PATENT AND TRADEMARK OFFICE

CERTIFICATE OF CORRECTION

PATENT NO. : 6,346,918 B1
DATED : February 12, 2002
INVENTOR(S) : Munk

It is certified that error appears in the above-identified patent and that said Letters Patent is hereby corrected as shown below:

Column 14,
Line 41, delete "$Z^{z}_{A-}(0,0) = Z^{x}_{A-}(0,0)$"

and replace with -- $Z^{z}_{A}(0,0) = Z^{x}_{A}(0,0)$ --.

Column 15,
Line 25, delete "separation a to be" and replace with -- -- separation α to be --.
Line 37, delete "lefthand CP" and replace with -- left-hand CP --.
Line 60, delete "separation a to be" and replace with -- -- separation α to be --.

Column 17,
Line 8, delete "bore-sight" and replace with -- boresight --.
Line 16, delete "E and H-plane" and replace with -- E and H-planes --.

Column 18,
Line 6, delete "the a scan" and replace with -- the scan --.

Column 20,
Line 23, delete "of not more one" and replace with -- of not more than one --.

Column 22,
Line 2, delete "is a spaced" and replace with -- is spaced --.

Signed and Sealed this

Twenty-sixth Day of November, 2002

*Attest:*

*Attesting Officer*

JAMES E. ROGAN
*Director of the United States Patent and Trademark Office*